US007828400B2

(12) United States Patent
Ikegame

(10) Patent No.: US 7,828,400 B2
(45) Date of Patent: Nov. 9, 2010

(54) IMAGE FORMING APPARATUS HAVING POSITION DETECTION MECHANISM

(75) Inventor: Tetsuo Ikegame, Tokyo (JP)

(73) Assignee: Olympus Corporation, Tokyo (JP)

( * ) Notice: Subject to any disclaimer, the term of this patent is extended or adjusted under 35 U.S.C. 154(b) by 636 days.

(21) Appl. No.: 11/311,680

(22) Filed: Dec. 19, 2005

(65) Prior Publication Data

US 2006/0132524 A1 Jun. 22, 2006

(30) Foreign Application Priority Data

Dec. 21, 2004 (JP) ..... 2004-368763

(51) Int. Cl.
*B41J 25/308* (2006.01)

(52) U.S. Cl. ..... 347/8; 347/5; 347/42

(58) Field of Classification Search ..... 347/16, 347/19, 42–43, 49, 5, 8, 9, 12, 116, 13
See application file for complete search history.

(56) References Cited

U.S. PATENT DOCUMENTS 6,603,495 B2 * 8/2003 Hayakawa ..... 347/116
6,869,166 B2 * 3/2005 Brugue et al. ..... 347/49
6,890,061 B1 * 5/2005 Freire et al. ..... 347/42
2002/0089556 A1 * 7/2002 Riou ..... 347/8

FOREIGN PATENT DOCUMENTS

JP 10-035021 A 2/1998

* cited by examiner

*Primary Examiner*—Lam S Nguyen
(74) *Attorney, Agent, or Firm*—Holtz, Holtz, Goodman & Chick, PC

(57) ABSTRACT

In an image forming apparatus having a recording head including a plurality of nozzle arrays for ejecting each ink droplet per color for plural colors respectively onto a transported recording medium, a positioning mechanism of the image forming apparatus having a detection mechanism for preventing a printing quality on a recording medium from degrading by comprising a transport mechanism for transporting in order to form an image on the recording medium, and a carriage placed on an opposite positions of the transport mechanism and a belt platen; placing a sensor for detecting a relative inclination between the transport direction and the recording head; detecting and calculating an inclination of the transport direction vis-à-vis the recording head, and controlling the relative inclination based on the calculation result.

12 Claims, 30 Drawing Sheets

IMAGE FORMING APPARATUS HAVING POSITION DETECTION MECHANISM

CROSS REFERENCE TO RELATED APPLICATION

This application claims benefit of Japanese Application No. 2004-368763, filed Dec. 21, 2004, the contents of which are incorporated by this reference.

BACKGROUND OF THE INVENTION

1. Field of the Invention

The present invention relates to an image forming apparatus for detecting and correcting a skew without degrading a printing quality of an image recording medium, and in particular to a technique for determining a position by detecting a skew.

2. Description of the Related Art

Conventionally, an image forming apparatus of an inkjet system forms an image by causing a large number of nozzles of a recording head to eject ink droplets onto a recording medium. Particularly, if a mutual displacement of each color is large, a degradation of printing quality results in the case of obtaining a color image by ejecting plural colors of ink onto a recording medium in sequence.

For instance, in the case of an image forming apparatus using a fixed line head, if a skew, i.e., the transport direction of a recording medium skews vis-à-vis a nozzle array placed in the line head, a plurality of colors does not land in the same position of the recording medium, resulting in a color shift.

A laid-open Japanese patent application publication No. 10-35021 has proposed a method for correcting a color shift caused by such a skew. As shown by FIG. 1, an image forming apparatus comprises two recording heads 231 and 232 which are placed on the upstream side and one recording head 234 which is placed on the downstream side. The upstream recording head groups 231 and 232 are fixed onto a support member 233, while the downstream recording head group 234 is fixed onto a support member 235 which is equipped movably against a support member 233.

The support member 233 is equipped movably relative to a swing member 239 which is equipped swingably around a shaft 2310. And a detection unit 237 is equipped in the upstream of the recording heads 231 and 232 for detecting a registration mark 236 printed on both sides of a recording material 2311. The registration mark is printed along with the image by the each color head.

A calculation unit 238 detects a skew of the recording material 2311 based on information from the detection unit 237 which has detected the registration mark and controls the positions of the support members 233 and 235, and the orientation of the swing member 239, thereby preventing a shift of each color.

The detection of a skew by the method noted by the above described patent document prints registration marks on both sides of a recording medium. This requires a printing of inherently unnecessary registration marks, resulting in the unnecessary marks remaining until the both sides are cut off after printing the entire page, et cetera, otherwise degrading a print quality. Such is the problem.

SUMMARY OF THE INVENTION

The purpose of the present invention is to provide a correction unit for an image forming apparatus having a skew detection mechanism in order to prevent degradation of a print quality.

One aspect of the present invention is an image forming apparatus having a recording head including a plurality of nozzle arrays for ejecting each ink droplet per color for plural colors respectively in a first direction onto a transported recording medium, having a transport mechanism for transporting the recording medium in a second direction in order to form an image thereon; placing the nozzle arrays in a predetermined interval, and in a position opposite to the transport mechanism; and comprising an inclination detection unit comprising a sensor for outputting a signal in order to generate information about a relative inclination between the second direction or the transport mechanism and the recording head around an axis that is perpendicular to the recording medium, and a correction mechanism for calculating based on the signal and correcting a relative inclination between the second direction and the recording head based on the calculation result.

The sensor may preferably be configured to output a signal for detecting a relative inclination between a belt which transports the recording medium and the recording head around the axis.

The sensor may preferably be configured to output a signal for detecting a relative inclination between a belt platen, on which a belt for transporting the recording medium is placed, and the recording head around the axis.

The sensor may preferably at least comprise a light source and a light receiving element for receiving light emitted from the light source.

The configuration may preferably be such that light emitted from the light source is incident on the light receiving element by way of a target, also the light source and the light receiving element are placed on either the recording head or the transport mechanism, and the target is placed on either the recording head or the transport mechanism where neither the light source nor the light receiving element is placed.

The configuration may preferably place the target on the entire circumference of the belt.

The sensor may preferably be configured to comprise at least a magnetic member and a magnetic sensor for detecting a magnetism of the magnetic member.

The sensor may preferably be configured as a velocity sensor for detecting a velocity of the recording medium and/or belt which transports the recording medium.

The sensor may preferably be configured as an optical velocity sensor.

The configuration may preferably be such that the optical velocity sensor comprises means for a changeover control of a light path of emitted light of the optical velocity sensor, thereby detecting a velocity from two directions by a time sharing.

The configuration may preferably be such that the inclination detection unit comprises two sets of sensors which are placed separately in the vertical direction vis-à-vis the first direction.

The configuration may preferably be such that the transport mechanism has a belt platen.

The configuration may preferably be such that the correction unit includes an inclination mechanism for inclining the transport mechanism relative to the recording head around the axis.

The configuration may preferably be such that the correction unit includes an inclination mechanism for inclining the recording head relative to the transport mechanism around the axis.

The configuration may preferably be such that the transport mechanism has a positioning unit for positioning relative to the recording head with the positioning direction being vertical to the axis and also the inclination mechanism is relatively inclined with the positioning unit as the center.

The configuration may preferably be such that the inclination is controlled by way of an engaged part which is linked with a gear on a motor, and by controlling the motor.

The configuration may preferably be such that the transport mechanism has a pin for positioning relative to said recording head with the positioning direction being vertical to said axis and the transport mechanism is relatively inclined relative to the recording head by the pin deforming elastically.

The configuration may preferably be such that the recording head is placed on a carriage and an inclination unit is included between the carriage and the transport mechanism for relatively inclining around the axis.

The configuration may preferably be such that the correction unit has a control unit for generating ejection information based on image information for inputting to the recording head and the control unit generates ejection information by causing a displacement in the nozzle row direction by a predetermined amount based on the signal.

The configuration may preferably be such that the predetermined amount is calculated from a reference position, a distance between a reference position and the nozzle row, and the signal.

The above described configuration eliminates a necessity of printing a mark, et cetera, other than a desired image for detecting a skew caused by a displacement of a recording medium vis-à-vis a transport direction in the process of forming an image on the recording medium, thereby preventing degradation of a print quality.

DESCRIPTION OF THE PREFERRED EMBODIMENTS

First Embodiment

The following is a detailed description of the preferred embodiment of the present invention while referring to the accompanying drawings. The following description deals with the first embodiment of the present invention while referring to the accompanying drawings.

Figure 1:
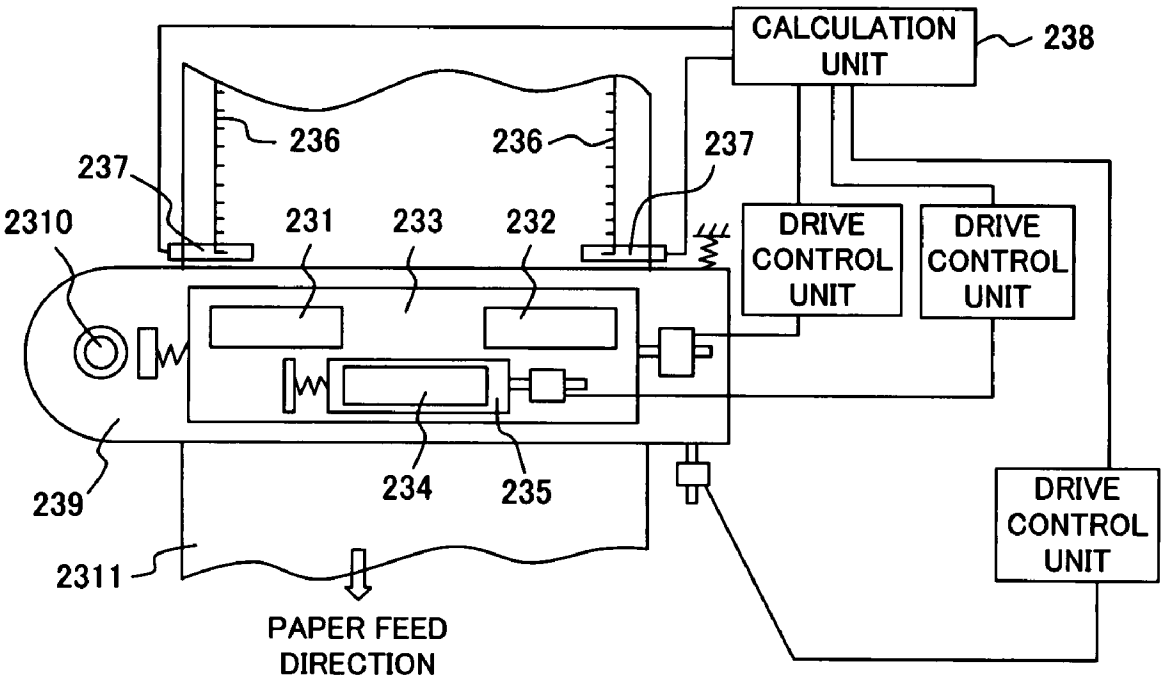
FIG. 1 shows a conventional example.
Figure 2:
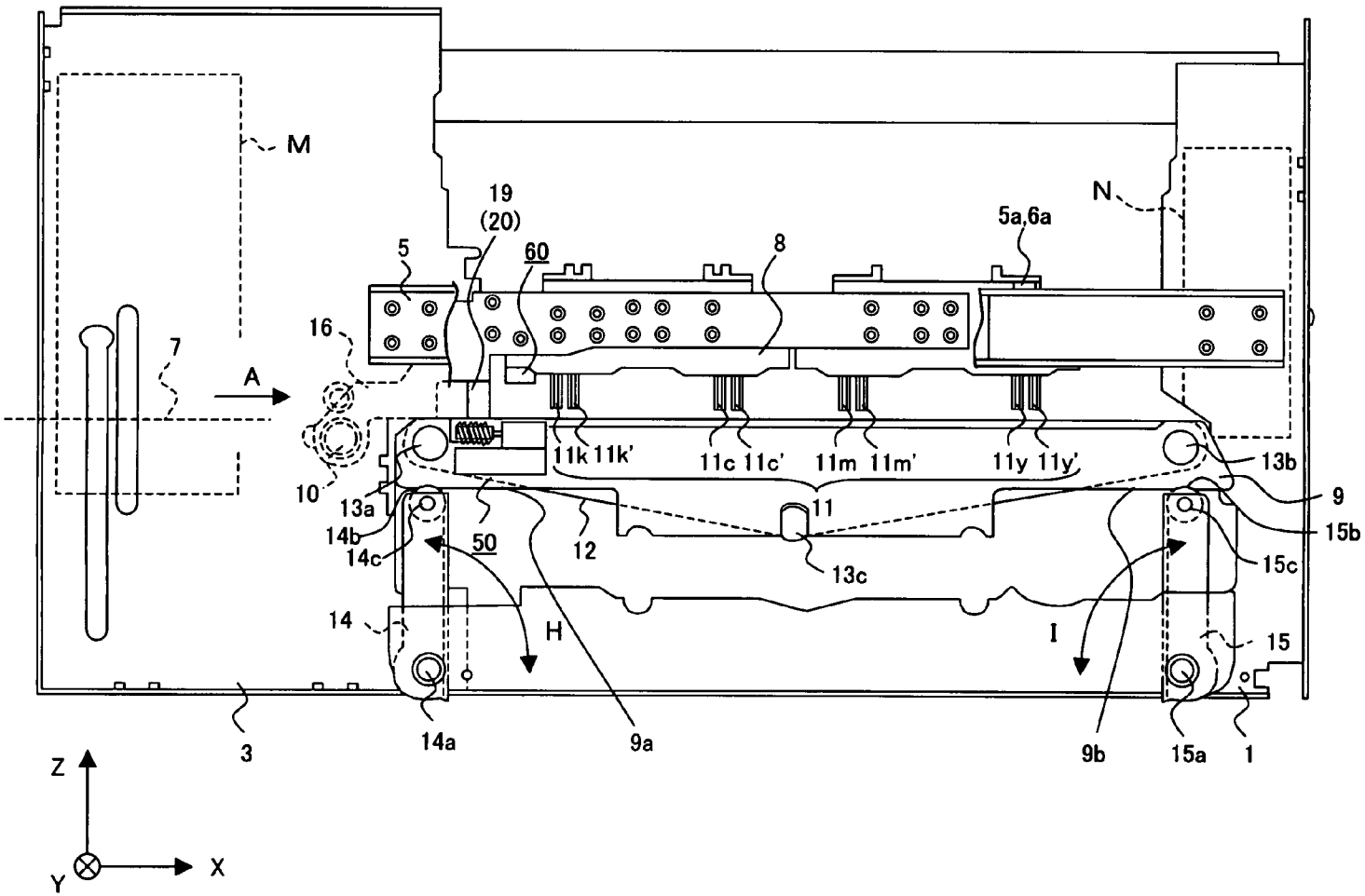
FIG. 2 is a side view of an image forming apparatus used by the present invention.
Figure 3:
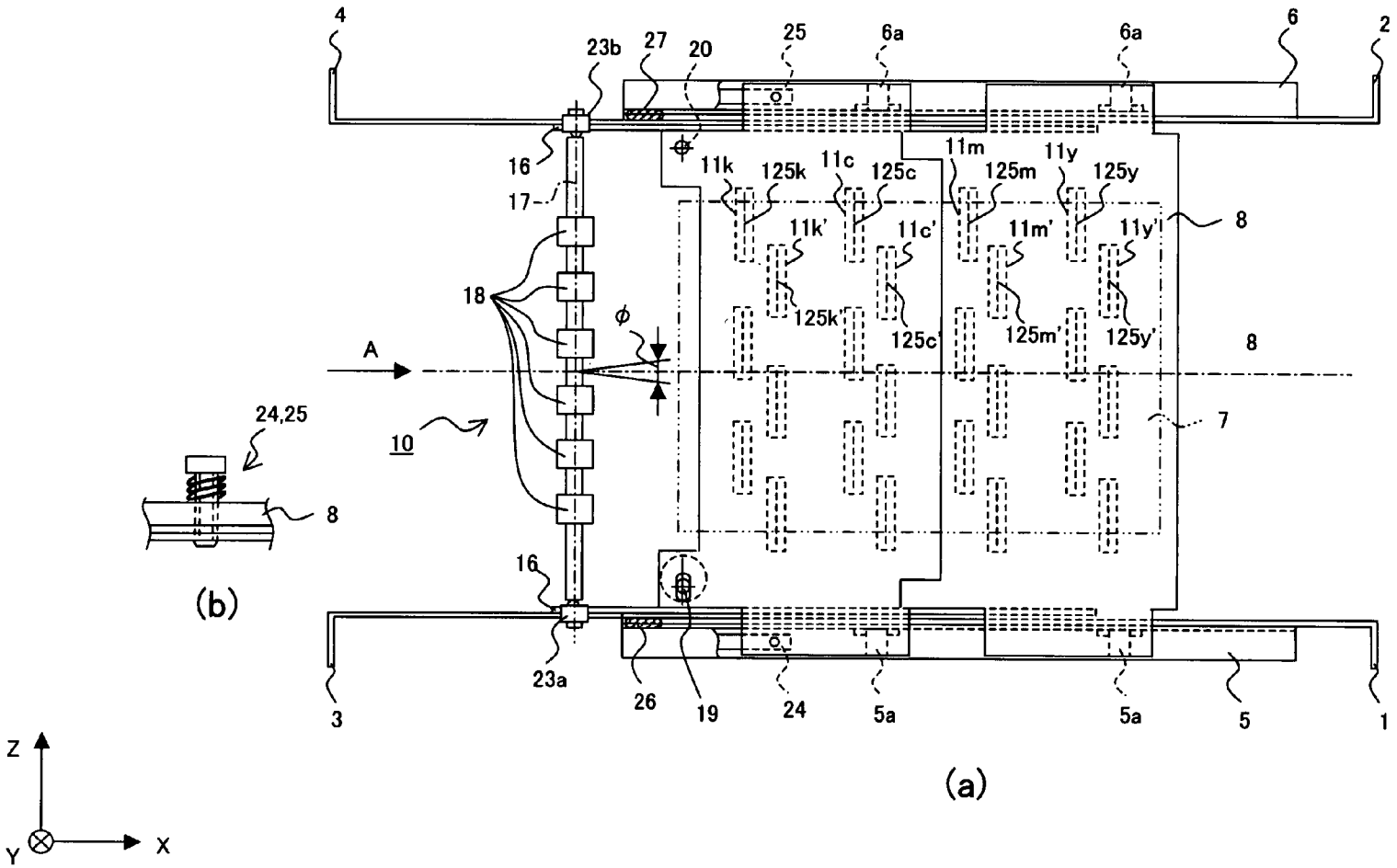
FIG. 3 shows the present embodiment, with (a) showing a plan view showing a carriage and a frame and surrounding area, with (b) showing a carriage guide mechanism.

FIGS. 2 and 3 are each a configuration diagram of a positioning structure of an image forming apparatus. FIG. 2 is a side view of an image forming apparatus used by the present invention. FIG. 3 is a plan view showing a carriage, and a frame and surrounding area.

The image forming apparatus adopts an inkjet system. In the image forming apparatus of the inkjet system, the definitions are: an X axis direction (i.e., second scan direction) for the transport direction of a recording medium 7; a Y axis direction (i.e., first scan direction) for the direction of the width of the recording medium 7, which is perpendicular to the X axis direction; and a Z axis direction (i.e., the up and down direction) for the direction of ink ejection from a recording head, which is perpendicular to the recording medium 7 and the X axis and Y axis directions.

Both sides of the image forming apparatus are equipped by respective first frames 1 and 2 respectively. Between the first frames 1 and 2 are connected to respective connection frames 5 and 6 fastened by screws. On the inside of the respective first frames 1 and 2 are equipped respective second frames 3 and 4.

The respective first frames 1 and 2 support a media exit unit (e.g., a paper exit unit if the medium is a recording paper) N for a recording medium 7 to exit, an ink supply mechanism for supplying an ink fluid of each color, i.e., black (K), cyan (C), magenta (M) and yellow (Y) (NB: these are not shown herein), and supports an electrical component system requiring such as a control circuit.

The respective second frames 3 and 4 support a media supply unit (e.g., a paper supply unit if the media are recording papers) M for supplying the image forming apparatus itself with a recording medium 7, and a rotating shaft (i.e., registration roller shaft) 17 for a registration roller unit 10 at both sides by way of bearings 23*a* and 23*b*. Furthermore, a carriage arm 16, one side of which being inserted into the bearings 23*a* and 23*b*, is fastened by screws on both sides of the carriage 8.

Moreover, the aforementioned carriage 8 is mounted with the height direction (i.e., Z axis direction) thereof being restrained by letting the other side thereof contact respective contact parts 5*a* and 6*a* of the respective connection frames 5 and 6 by carriage guide mechanisms 24 and 25 shown by FIG. 3 (*b*).

The carriage 8 holds respective ink head groups 11*k*, 11*k*', 11*c*, 11*c*', 11*m*, 11*m*', 11*y* and 11*y*' (referred to as "ink head groups 11*k*, 11*k*' through 11*y*'" hereinafter) which constitute a recording head 11 for ejecting respective color inks, i.e., black (K), cyan (C), magenta (M) and yellow (Y). These ink head groups 11*k*, 11*k*' through 11*y*' are arranged so that a plurality of ink heads is arrayed in the direction perpendicular (i.e., Y direction) to the transport direction A of the recording medium 7 in two columns of three, with the head nozzle rows being arrayed so as to overlap with one another so as to prevent a gap from existing at the time of forming an image.

The ink head groups 11*k*, 11*k*' through 11*y*' are capable of printing the entire print width of the recording medium 7 in the Y direction, and comprise fixed line heads which are fixed relative to the transported recording medium 7.

A belt platen 9 is placed underneath and facing the bottom face of the carriage 8 movably in the up and down directions. The belt platen 9 supports an endless belt 12 a lá band for example by providing a tension by three platen rollers 13*a*, 13*b* and 13*c* for example and moves the belt 12 by rotationally driving the downstream roller 13*b*. The belt 12 is featured with a plurality of holes (not shown herein) and the air is sucked from these holes by a suction mechanism (not shown herein), thereby suction-holding the recording medium 7 onto the belt 12. By so doing, the recording medium 7 is transported by moving the belt 12 in the transport direction of A at a constant speed. Note that the belt 12, three platen rollers 13*a*, 13*b* and 13*c*, and belt platen with the suction mechanism constitute a transport mechanism for transporting the recording medium 7 in the transport direction A.

The belt platen 9 is retained by roller units 14*b* and 15*b* at each side of two platen lift mechanism arms 14 and 15, which is the lift mechanism of the belt platen, at each of lower edge braces 9*a* and 9*b* that are formed on both sides of the aforementioned belt platen 9.

Figure 4:
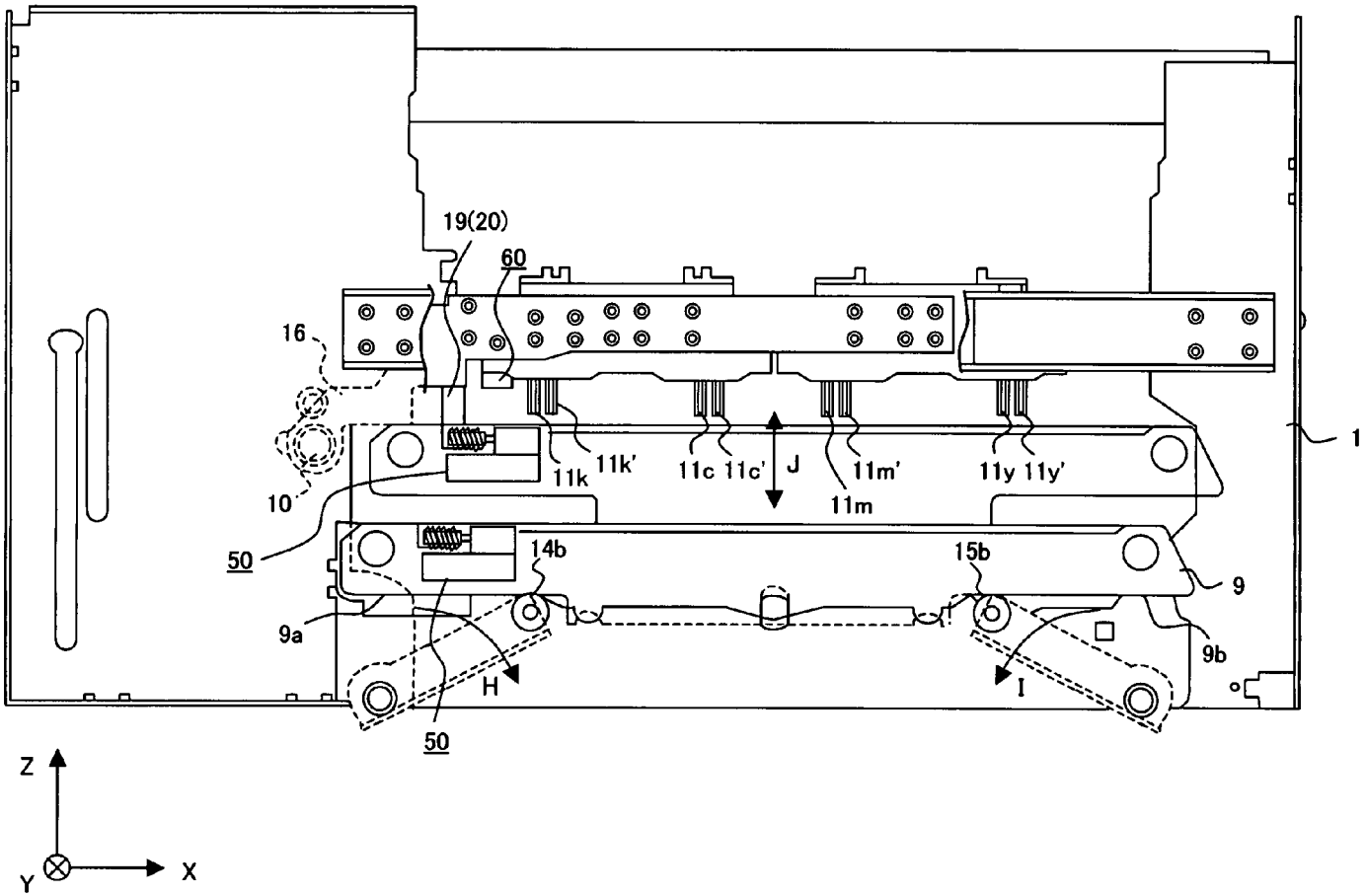
FIG. 4 is a side view of an image forming apparatus used by the present embodiment.

These platen lift mechanism arms 14 and 15 are supported by shafts 14*a* and 15*a*, respectively, rotationally and synchronously in the directions of the arrows H and I, respectively. As these platen lift mechanism arms 14 and 15 rotate synchronously, the roller units 14*b* and 15*b* equipped at the respective ends of each of the platen lift mechanism arms 14 and 15 move each of the lower edge braces 9*a* and 9*b* of the belt platen 9 as shown by FIG. 4. This raises or lowers the belt platen 9 in the direction of the arrow J (i.e., the Z axis direction). And the roller units 14*b* and 15*b* are freely rotationally supported by the roller shafts 14*c* and 15*c* which are equipped in the platen lift mechanism arms 14 and 15. Note that each of the lower edge braces 9*a* and 9*b* of the belt platen 9 is featured on the upstream and downstream sides of the transport direction A of the recording medium 7.

The belt platen 9 is placed at a height position narrowing the distance between the belt platen 9 and the ink ejection gates of the respective ink head groups 11*k*, 11*k*' through 11*y*' on the carriage 8 down to a preset gap for forming an image, at the time of forming an image on a recording surface of the recording medium 7, as shown by FIG. 2. Meanwhile, at the time of a jamming recording medium 7 or a maintenance of the respective ink head groups 11*k*, 11*k*' through 11*y*' (e.g., a paper jam clearance), the belt platen 9 is placed at a height position increasing the distance, to a predetermined gap for maintenance, between the belt platen 9 and ink ejection gates of the respective ink head groups 11*k*, 11*k*' through 11*y*' at the carriage 8, as shown by FIG. 4.

Figure 5:
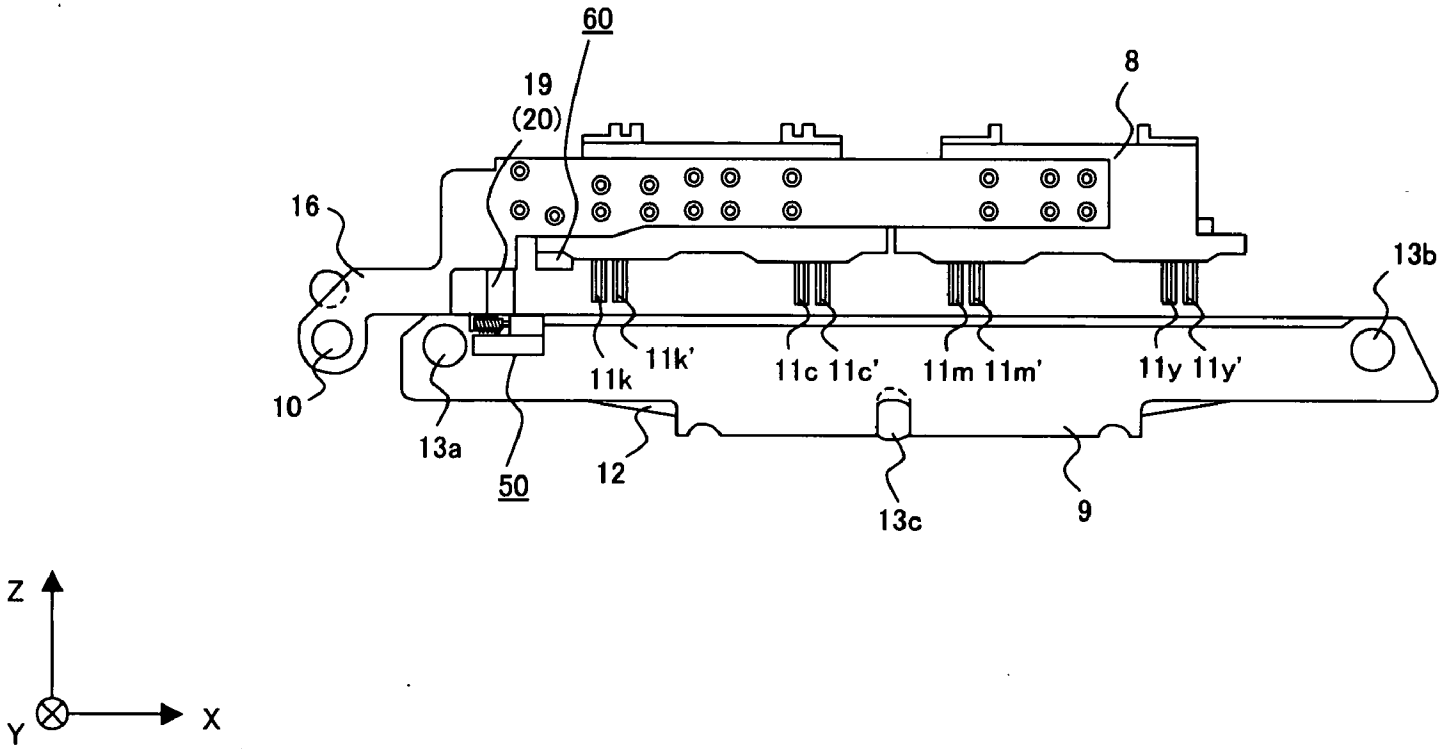
FIG. 5 is a side view showing a relationship between each carriage arm 16 and a carriage 8.

As shown by FIG. 5, the respective carriage arms 16 are formed by extending from both sides of the carriage 8. These carriage arms 16 are featured in the immediate downstream of the supply part M of the recording medium 7 on the carriage 8.

The lowest parts of these carriage arms 16 are respectively inserted by the bearings 23*a* and 23*b* which rotationally support a registration roller unit 10 on the inside of the second frames 3 and 4 at both sides of the registration roller shaft 17. The height position, which supports the registration roller unit 10, is held so as to make the top surface of each roller 18 of the aforementioned registration roller unit 10 approximately the same height as that of the belt 12 on the belt platen 9, and is equipped with rollers which are respectively paired with the rollers 18 of the registration roller unit 10 which is mounted in the Y axis direction, i.e., the direction approximately perpendicular to the transport direction A of the recording medium 7. That is, the registration roller unit 10 is mounted in parallel with the respective ink head groups 11*k*, 11*k*' through 11*y*'.

The registration roller unit 10 comprises a shaft 17 and respective rollers 18 mounted thereon at a predetermined interval. Both ends of the shaft (i.e., a registration roller shaft) 17 of the registration roller unit 10 are respectively supported rotationally by the respective second frames 3 and 4 by way of the bearings 23*a* and 23*b*, as shown by FIG. 3, with the bearings 23*a* and 23*b* being inserted into the carriage arm 16, thereby being integrally structured with the carriage 8.

Respective carriage pins 19 and 20 are fixed onto the carriage 8 so as to protrude downward in the Z axis direction. These carriage pins 19 and 20 position themselves on both sides in the Y axis direction, i.e., the width direction of the recording medium 7, and on the upstream side thereof, of the carriage 8.

Each of these carriage pins 19 and 20 is featured a 1*a* circular column by using a high rigidity material, with its lower end being formed a lá cone. These carriage pins 19 and 20 are inserted into the belt platen 9 for controlling the positional relationship between the carriage 8 and belt platen 9 so as to make a transported attitude of the recording medium 7 which is fed in from the registration roller unit 10 approximately identical with that of the recording medium 7 to the belt platen 9.

Figure 6:
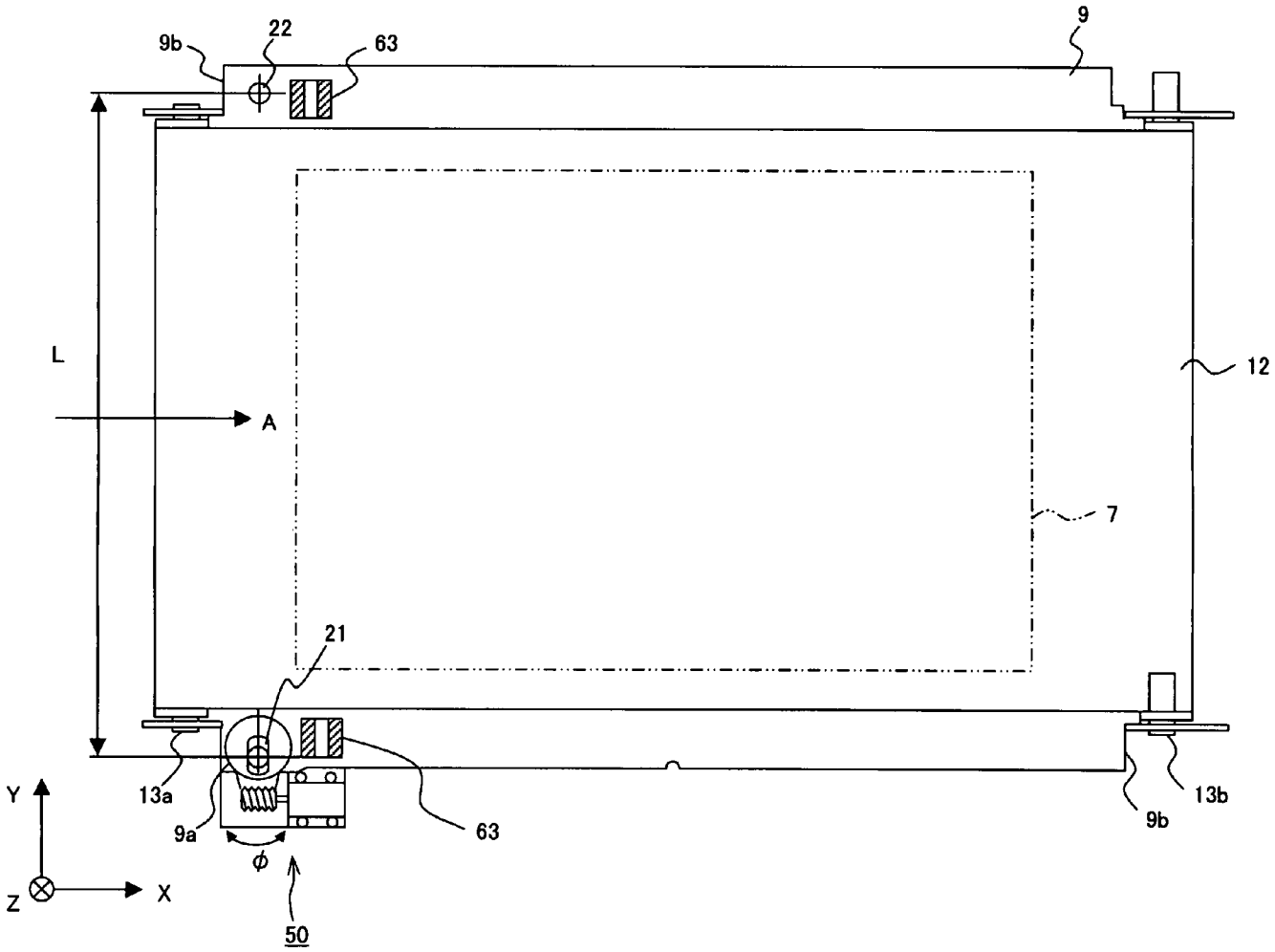
FIG. 6 is a plan view showing each positioning hole for controlling a position.

Meanwhile, respective positioning holes 21 and 22 are provided at positioning parts for controlling positions as shown by FIG. 6 at the respective positions on the belt platen 9 facing the above described carriage pins 19 and 20. These positioning holes 21 and 22 are featured respectively at the both edge braces 9*a* and 9*b*, and on the upstream side, of the belt platen 9.

The one positioning hole 21 is disposed for inserting the carriage pin 19 and is featured with an elongated hole with the long side extending in approximately the Y axis direction. The size of the positioning hole 21 in the X axis direction is formed to be of approximately the same diameter as that of the carriage pin 19 and yet allow an insertion.

The other positioning hole 22 is disposed for inserting the carriage pin 20 and is featured with a circular hole. The diameter of the positioning hole 22 is formed to be of approximately the same diameter as that of the carriage pin 20 and yet allow an insertion.

An image forming operation in the above described configuration is such that, as a recording medium 7 is transported, the recording medium 7 is regulated by stopping the registration roller unit 10 for the transported attitude, followed by being carried into the belt platen 9 by a transporting force. The belt platen 9 transports the recording medium 7 toward the downstream of the respective ink head groups 11*k*, 11*k*' through 11*y*', following transporting thereto, along with a movement of the belt 12 while suction-holding the aforementioned recording medium 7 onto the belt 12.

On thus transporting the recording medium 7, an image is formed by jetting each ink droplet, i.e., black (K), cyan (C), magenta (M) and yellow (Y), sequentially from the respective ink head groups 11*k*, 11*k*' through 11*y*' in the Z axis direction (i.e., the negative Z direction; simply called "negative" hereinafter).

In this event, the above described actions maintain a mutual relationship of perpendicularity between the axis direction of the registration roller unit 10 and transport direction A of the belt platen 9, resulting in hardly allowing a positional shift of the respective colors on the recording medium 7 as described above.

Meanwhile, at the time of maintenance, the lift mechanism arms 14 and 15 rotate synchronously around the shafts 14*a* and 15*a* respectively so that the belt platen 9 descends as shown by FIG. 4, widening the distance between the belt platen 9 and the ink ejection gates of the respective ink head groups 11*k*, 11*k*' through 11*y*' on the carriage 8 to a predetermined gap for maintenance, thus allowing a clearance of a recording medium 7, a jam clearance, a maintenance of the respective ink head groups 11*k*, 11*k*' through 11*y*', et cetera. After finishing such maintenance, the belt platen 9 is raised again so as to place it at a position narrowing the distance between the belt platen 9 and the ink ejection gates of the respective ink head groups 11*k*, 11*k*' through 11*y*' on the carriage 8 down to a predetermined gap for forming an image.

Also in this event, since the respective carriage pins 19 and 20 of the carriage 8 are inserted into the respective positioning holes 21 and 22 on the belt platen 9 as described above, the positional relationships between the registration roller unit 10, carriage 8 and belt platen 9 are maintained, thus maintaining the perpendicular relation between the axial direction of the registration roller unit 10 and transport direction A of the belt platen 9.

Therefore, the positional relationship among the registration roller unit 10, carriage 8 and belt platen 9 are maintained no matter how many times a relative movement of the carriage 8 and belt platen 9 is repeated.

The next description is of important components. Respective positions on the belt platen 9 corresponding to the carriage pins 19 and 20 are respectively featured with the respective positioning holes 21 and 22 for controlling positions as shown by FIG. 6. These positioning holes 21 and 22 are respectively featured at the both edge braces 9*a* and 9*b*, and on the upstream side, of the belt platen 9. The one positioning hole 22 is disposed for inserting the carriage pin 20 and is featured with a circular hole, with the diameter of the positioning hole 22 being of a size approximately the same as that of the diameter of the carriage pin 20 and yet allowing the insertion thereof.

The other positioning hole 21 is disposed for inserting the carriage pin 19 and is formed as an elongated hole with the long dimension extending in approximately the Y direction.

Figure 7:
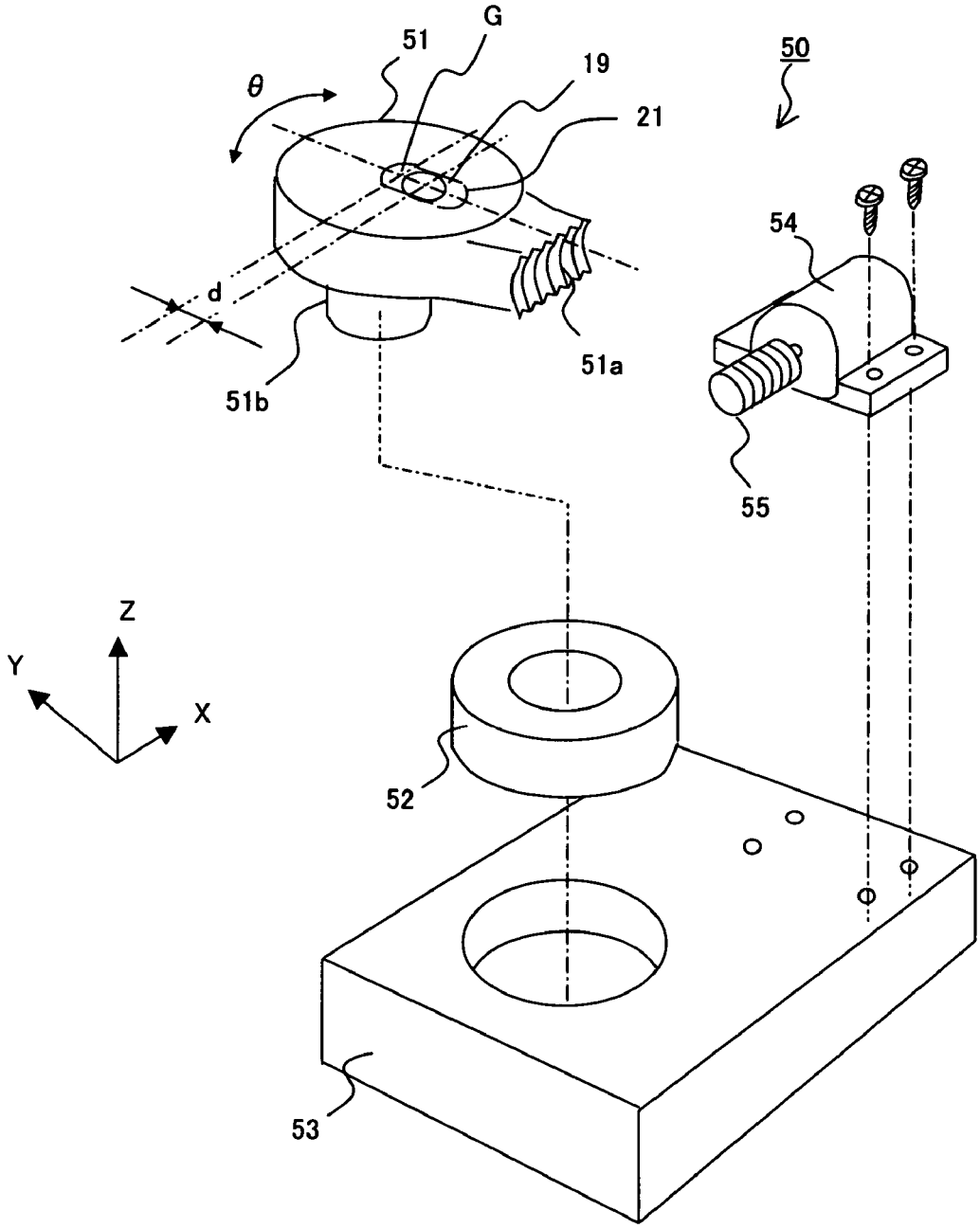
FIG. 7 shows how the center of a positioning hole 21 featured in a moving mechanism 50 is placed by offsetting it in the Y direction relative to the center G of the rotation member 51 by d, and a worm wheel 51*a* is featured at one end surface in the Y direction of the rotation member 51.

The positioning hole 21 is comprised by a moving mechanism 50 as shown by FIG. 7. The center of the positioning hole 21 is placed by offsetting it by the distance d in the Y axis direction relative to the center G of a rotating member 51. One end surface of the rotating member 51 in the Y axis direction is featured by a worm wheel 51*a*.

A shaft part 51*b* of the rotating member 51 is fixed rotationally relative to a fixed member 53 by way of a bearing 52. And the fixed member 53 is fixed to the belt platen 9. And a motor 54, that is, a stepper motor comprising a worm gear 55 engaging with the worm wheel 51*a*, is also fixed onto the fixed member 53.

Figure 8:
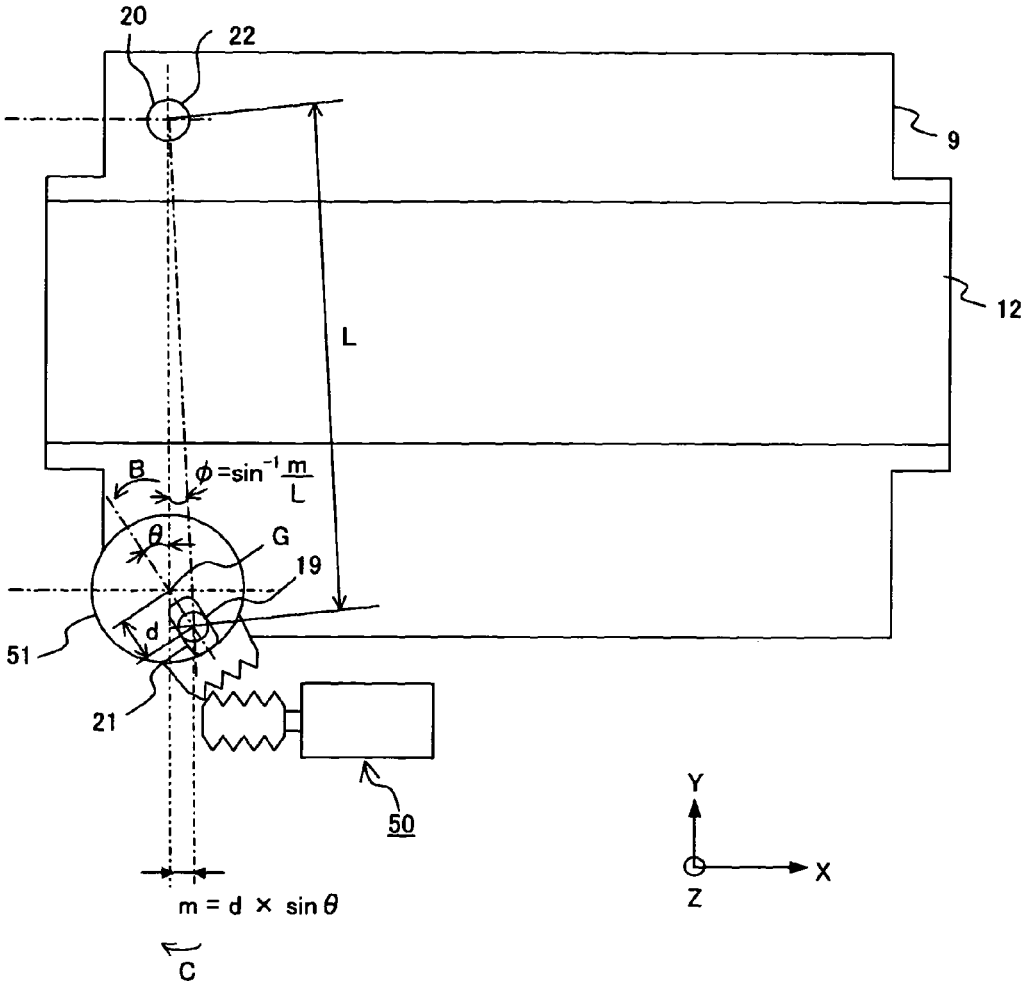
FIG. 8 shows the distance L between the centers of a carriage pin 20 and carriage pin 19, a rotation angle θ relative to the center G of the rotation member 51, and a rotation angle ϕ relative to the carriage pin 20 of a belt platen 9.

The following description is of an operation based on FIG. 8. Definitions here are: the distance L between centers of the carriage pins 19 and 20; the distance d between the center G of the rotating member 51 and the center of the carriage pin 19; the rotation angle θ of the rotating member 51 around the center G; and the rotation angle ϕ of the carriage pin 20 of the belt platen 9. When making the motor 54 rotate to make the worm gear 55 rotate, the rotating member 51 rotates around the rotation center G in the direction B by the angle θ. This makes the positioning hole 21 and the carriage pin 19 being inserted therein move by $m=d*\sin\theta$ in the X (positive) direction relative to the belt platen 9. This makes the belt platen 9 rotate by the angle ϕ around the center of the carriage pin 20 in the direction C relative to the carriage 8, that is, the respective ink head groups 11*k*, 11*k*' through 11*y*' which are fixed thereon. Here, the angle ϕ is expressed by $\sin^{-1}(m/L)$.

Meanwhile, the planar lower edge braces 9*a* and 9*b* of the belt platen 9 are placed on the roller units 14*b* and 15*b* which are the cylindrical outer forms of the respective platen lift mechanism arms. Because of this, the belt platen 9 is supported allowing a movement and inclination in the directions parallel to the XY plane by the belt platen 9 sliding on the roller units 14*b* and 15*b*. And the carriage 8 fixing the respective ink head groups 11*k*, 11*k*' through 11*y*' is fixed to the first frames 1 and 2, and the respective second frames 3 and 4.

Because of the above described comprisal, a rotation of the positioning hole 21 by an angle θ makes it possible to incline the belt platen 9 around the Z axis direction by the angle ϕ relative to the center of the carriage pin 20, which is fixed to the carriage 8 that is then fixed to the first frames 1 and 2, and the respective second frames 3 and 4. When inclining the belt platen 9 in the reverse direction to that of the direction C shown by FIG. 8, the worm gear 55 is simply rotated in the reverse direction to that of the above description.

For example, assuming the distance 300 mm between the ink heads 11*k* and 11*y* in the transport direction of a recording medium, a correction of the position of the ink heads 11*k* and 11*y* in the Y axis direction by half the pitch of 300 dpi, that is, 0.042 mm (i.e., 25.4/300/2), by inclining the belt platen 9 relative to the carriage 8 is performed as follows.

The belt platen 9 only has to incline by the angle $\phi$=0.0081 degrees (i.e., $\sin^{-1}$ (0.042/300).

In another example, if L=400 mm, d=10 mm, the inclination angle $\theta$ is 0.32 degrees from the above described expression, by making the motor 54 rotate until the rotating member 51 rotates 0.32 degrees. Thus, it is possible to incline the belt platen 9 relative to the carriage 8, that is, the ink head groups 11*k*, 11*k*' through 11*y*' and registration roller unit 10 which is integrally comprised therewith around the Z axis. By this configuration, if the transport direction of the belt 12 or that of the recording medium 7 is skewed relative to the ink head groups 11*k*, 11*k*' through 11*y*', the skew can be corrected by inclining the belt platen 9 relative to the carriage 8.

The next description is of sensors.

The present embodiment is configured to detect an inclination of the belt platen 9 relative to the carriage 8, that is, the ink head groups 11*k*, 11*k*' through 11*y*', which are fixed thereon, around the Z axis. The Z axis is perpendicular to the transport direction X of a recording medium 7, perpendicular to the recording surface of the recording medium 7 on the belt platen 9 and a parallel direction to the jetting direction of an ink droplet ejected from the ink head 11*k*, et cetera.

Figure 9:
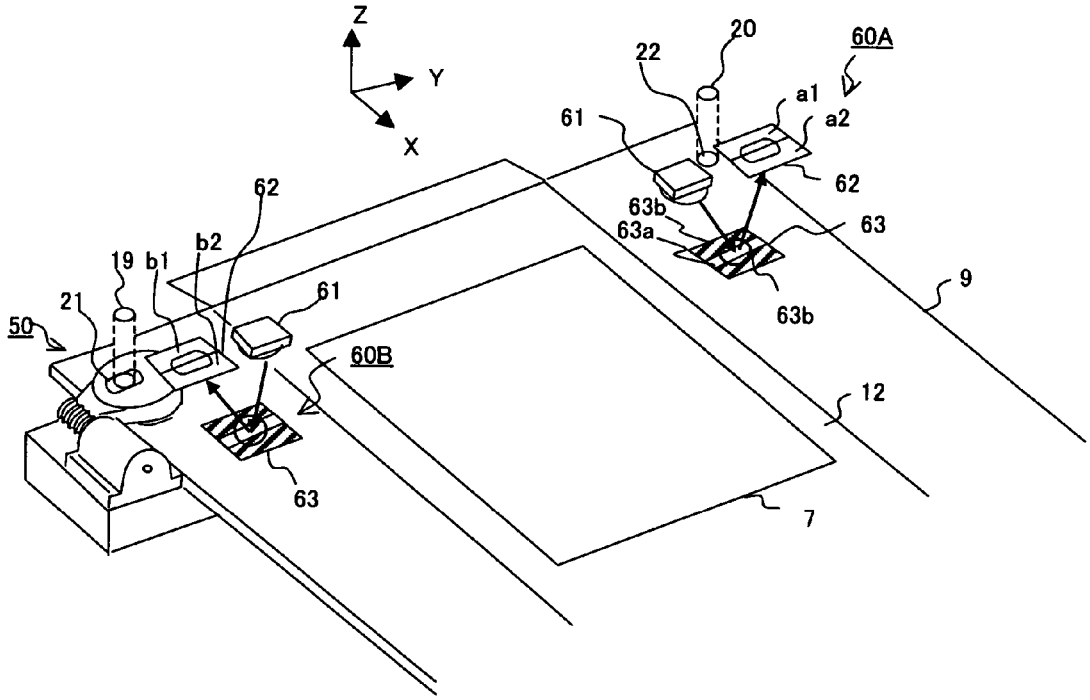
FIG. 9 shows a placement of a reflection target 63 adjacent to positioning holes 21 and 22 placed on the upstream side on both sides of the belt platen 9.

As shown by FIG. 9, reflection targets 63, as targets, are placed adjacent to the positioning holes 21 and 22 which are placed on the both ends and upstream side of the belt platen 9.

A reflection target 63 is configured by a square flat glass plate, with its surface being divided into three parts by border lines parallel with the Y axis. The center reflection surface 63*a* is coated to have a high reflectance ratio of 95% or greater, for example, for the light of the wavelength of 900 nm, while the reflection surface 63*b* on the sides are coated to have a low reflectance ratio of 5% or less, for example, for the light thereof.

An LED (light emitting diode) 61 and a light receiving element 62 are placed on the carriage 8 so as to face each of the reflection targets 63. Note that the LEDs 61, light receiving elements 62 and reflection targets 63 constitute sensors 60A and 60B, respectively. The light receiving surface of the light receiving element 62 of the sensors 60A, or 60B, is divided into two parts a1 and a2, or b1 and b2, respectively, by a border line parallel with the Y axis direction (NB: a1 and b1 are located on the upstream side, while a2 and b2 are located on the downstream side). The LED 61 emits a near infrared ray of the wavelength 900 nm. A divergent light or parallel light emitted from the LED 61 is projected onto the reflection target 63. The envelope of the light in this event is a little larger than the width of the center reflection surface in the X axis direction as shown by FIG. 9. The LED 61, reflection target 63 and light receiving element 62 are placed so that the light a lá elongate hole reflected by the center reflection surface 63*a* with a high reflectance ratio, of the aforementioned outer form of the light, is incident at the center of the light receiving element 62. Two each of the LED 61, light receiving element 62 and reflection target 63 are placed so that the center is on a straight line which is parallel with the Y axis direction viewed from the Z axis direction.

Figure 10:
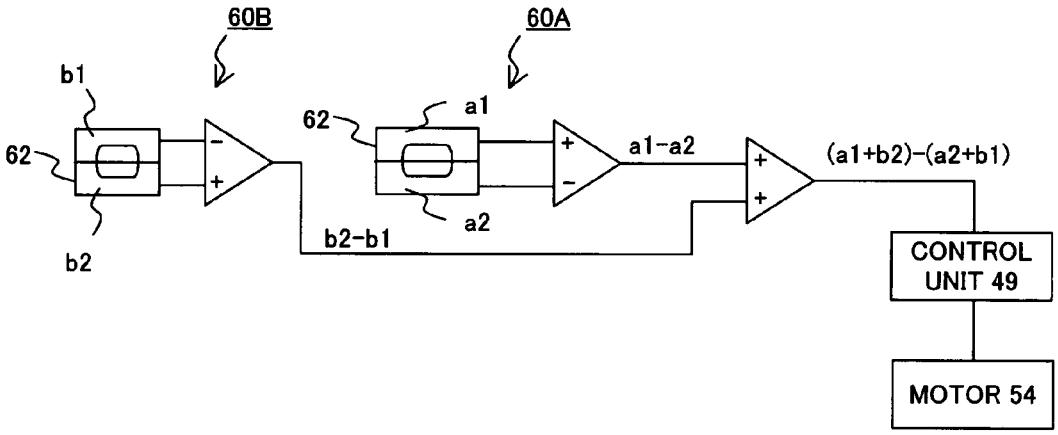
FIG. 10 shows a calculation of an inclination information as a result of calculation processing (NB: taking sums of diagonal signals of light receiving surfaces a1, a2 and b1, b2 which are divided as in the case of FIG. 9, thereby obtaining a differential signal)

Having received the light emitted from the LED 61 by way of the reflection target 63, the light receiving element 62 outputs electric signals from the divided light receiving surfaces a1 and a2, and b1 and b2, and obtains an inclination information by calculating an expression, i.e., ((a1+b2)−(a2+b1)), as shown by FIG. 10. The inclination information is obtained by taking sum signals of diagonal parts of the light receiving surfaces a1 and a2, and b1 and b2, which are divided as seen in FIG. 10, followed by taking the difference signal. Note that the inclination information may be normalized by summing all of the signals of the four light receiving surfaces, by an expression, i.e., ((a1+b2)−(a2+b1))/(a1+a2+b1+b2), which is a preferable method for minimizing error in the inclination information due to a light intensity change.

Figure 11:
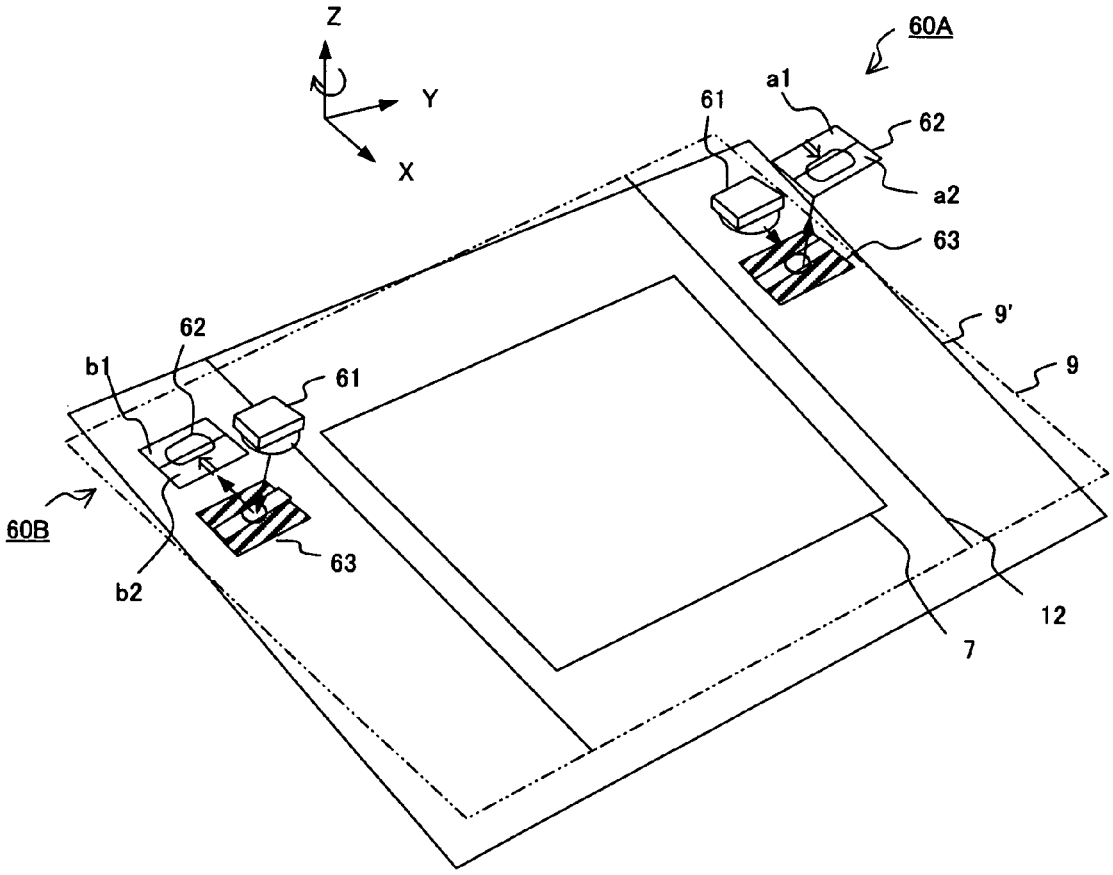
FIG. 11 assumes the case of the state of a belt platen 9', as a result of the belt platen 9, as shown by the double dotted lines, which is not skewed relative to a carriage 8, being rotated in the direction of an arrow around the Z axis as shown by FIG. 11.

As shown by FIG. 11, a state is assumed in which the state of the belt platen 9, shown by double dotted lines, not being skewed relative to the carriage 8 transiting to a belt platen 9' by rotating in the direction of the arrow around the Z axis shown by FIG. 11.

In this event, since the center of the reflection target 63 is shifted relative to that of the light from the LED 61, the reflecting light therefrom is also shifted toward the divided light receiving surfaces a2 and b1 as shown by FIG. 11. As a result, signals from the light receiving surfaces a2 and b1 increase, while those from the light receiving surfaces a1 and b2 decrease, thus the inclination information changes from zero to a negative value. Therefore a state of inclination between the belt platen 9 and carriage 8 around the Z axis can be detected.

Note that, if the belt platen 9 moves in parallel with the Y axis direction, an inclination information remains unchanged because the moving direction is parallel with the border lines of the reflection target 63. And, if the belt platen 9 moves in parallel with the X axis direction, the light incident on the light receiving element 62 also moves in the X axis direction, thus increasing signals from the light receiving surfaces a1 and b1, while decreasing signals from the light receiving surfaces a2 and b2, the inclination information, however, remains unchanged by the movement in the X axis direction because the inclination information is calculated by the expression, i.e., ((a1+b2)−(a2+b1)).

And, if the belt platen 9 is moved in the Z axis direction relative to the carriage 8 in order to respond to a recording medium with a different thickness, et cetera, the beams of the light propagating from the LED 61 to the light receiving element 62 by way of the reflection target 63 are in the YZ plane, the reflection target 63 has borders parallel with the YZ plane and the surface of the light receiving element 62 is divided by division lines parallel with the YZ plane. Because of this, even if the reflection target 63 moves up or down because the belt platen moves up or down, the inclination information remains unchanged because the light on the reflection target 63 and light receiving element 62 merely move in the direction parallel with the YZ plane.

Therefore, only an inclination between the belt platen 9 and carriage 8 around the Z axis can be detected.

Inputting the detected signal as described above to a control unit 49, controlling a rotation of the motor 54 thereby and so controlling it so as to make an inclination information zero can control an inclination of the belt platen 9 relative to the carriage 8 around the Z axis, thereby making it possible to correct a skew in the transport direction of the belt 12 and thus in transporting the recording medium 7 relative to the respective ink head groups 11*k*, 11*k*' through 11*y*' and therefore reduce a color shift.

Note that, if an image is known as optimum with an inclination information being a predefined value in lieu of zero as a result of an initial color shift inspection, et cetera, the control is to obtain the predefined value.

It is also possible to set an optimum inclination of the belt platen 9 by forming an image on the recording medium 7 by inclining the belt platen 9 by the rotation of a predetermined angle, e.g., 0.005 degrees, and minimizing a color shift from the relationship of the angle and color shift of the image.

An example of the carriage 8 and belt platen 9 inclining around the Z axis includes for example a deformation of the second frames 3 and 4 relative to the first frames 1 and 2 due to an external shock, vibration, et cetera. Also included is a deformation of the carriage pins 19 and 20 for controlling the relative position between the carriage 8 and belt platen 9 due to an external shock, vibration, et cetera.

Even in these cases, it is possible to detect a relative inclination between the carriage 8 and belt platen 9 around the Z axis and correct it as described above.

The present embodiment is configured to integrate the registration roller unit 10 with the carriage 8 and correct an inclination of the belt platen 9 relative to the registration roller unit 10 and carriage 8, and therefore the relative position between the registration roller unit 10 and carriage 8 does not shift if the belt platen 9 is inclined relative to the carriage 8.

And an inclination of the belt platen 9 is corrected around an axis perpendicular to the recording medium 7 on the belt platen 9 opposite the carriage 8 on which the ink heads are placed and therefore the distance between the recording medium 7 and ink heads does not change if the belt platen 9 is inclined. This prevents the ink heads from coming closer to the recording medium 7 and a jam from occurring easily.

And the carriage 8 placing all color ink heads is integrated as one and an inclination of the belt platen 9 is corrected relative to the carriage 8, and therefore a relative position of each color in the Y axis direction remains unchanged even if the inclination of the belt platen 9 is corrected. And an inclination correction unit may also be one set.

Contrary to the above, if an ink head for each color is corrected relative to the belt platen 9 for example, the position of each color in the Y axis direction shifts, thus resulting in a color shift. And a plurality of inclination correction units is required for each color, making the apparatus large.

Also, use of an infrared light source, in place of a visible light source, makes it comparably immune to an influence of a contamination by ink on the reflection target, et cetera.

Incidentally, while the present embodiment is configured to fix a part of the sensors to the carriage 8, it can be fixed to a discretionary member being integrated with the ink head, even to the ink head per se for example. Or, if a positional displacement between the carriage 8 and frame fixing the carriage 8 is small, then a part of the sensors may be placed on the frame, et cetera, in place of the carriage 8.

And the same benefit can be obtained if the reflection target 63 is placed on the carriage 8, and the LED 61 and light receiving element 62 are placed on the belt platen 9.

And the present embodiment is configured to place the two sensors 60A and 60B on the upstream side, and both sides in the Y axis direction, of the belt platen 9, they may be placed on the downstream side, however.

It is also possible to place the two sensors 60A and 60B on one side in the Y axis direction and in mutually separate positions in the X axis direction, or in mutually diagonal positions of the belt platen 9.

And, though the present embodiment uses an LED as the light source, an LD (laser diode) or other light source may be used instead. And, instead of using a light receiving element whose light receiving surface is bi-divided, such as PD (photo diode), for a light receiving element, a positional detection element (e.g., S4583-04, manufactured by Hamamatsu Photonics KK, et cetera), whose light receiving face is undivided, for outputting a signal relating to the center of gravity of a light intensity distribution being projected onto the light receiving surface, or alternatively, a CCD (charge coupled device) sensor may be employed.

The above described configuration detects an inclination of a fixed part of the belt platen 9, which does not move in the transport direction A, relative to the carriage 8, in lieu of the moving belt 12 which constitutes a part of the belt platen 9, i.e., the transport mechanism, or the recording medium 7 transported by the belt 12. When the belt platen 12 is inclined, however, the belt 12 driven by the platen rollers 13*a*, 13*b* and 13*c* which constitute a part of the belt platen 9 are also inclined by the same angle as that of the belt platen 12. Moreover, when the belt platen 9 is inclined, the transport direction of the recording medium 7 transported by the belt 12 is also inclined by the same angle. Therefore, the present embodiment is configured to substitute by detecting an inclination of a stationary part of the belt platen 9 which is related to an inclination of the transport direction of the recording medium 7 for an inclination of the transport direction A of the recording medium 7 relative to the carriage 8, that is, the ink head 11*k*, et cetera, which are fixedly placed thereon, although the substitution causes some error. The belt 12 and recording medium 7 which move in the transport direction A tend to cause a fluctuation of a reflectance by the movement. Also, contrary to the recording medium 7 which has various surface reflectances, sizes, surface deformations, et cetera, detecting the reflection target 63 which does not move in the transport direction A relative to the LED 61 by the light receiving element 62 being fixed to a stationary part of the belt platen, provides a benefit of a stable detection. Meanwhile, a print quality is maintained since there is no need to print a specific reflection target on the recording medium 7.

The above described comprisal enables a detection of a relative inclination between the carriage 8, that is, the ink head 11*k*, et cetera, integrally structured therewith, and the belt platen 9, i.e., the transport mechanism, that is, the moving direction of the belt 12 placed thereon, that is, the transport direction of the recording medium 7, which is transported by the belt 12, around the Z axis which is crossing and perpendicular to the recording medium. Furthermore, a correction of the inclination of the belt platen 9 corrects a relative inclination thereof around the actuality any axis parallel to the Z axis which is crossing and perpendicular to of the recording medium and also positional displacements of ink droplets ejected from the ink head groups onto the recording medium, thereby making it possible to reduce a color shift and improve quality of an image formed on the recording medium 7.

Second Embodiment

The following description deals with a second embodiment according to the present invention. Note that the following description omits parts of the same comprisal as those of the first embodiment and only concerns those parts that are different.

Figure 12:
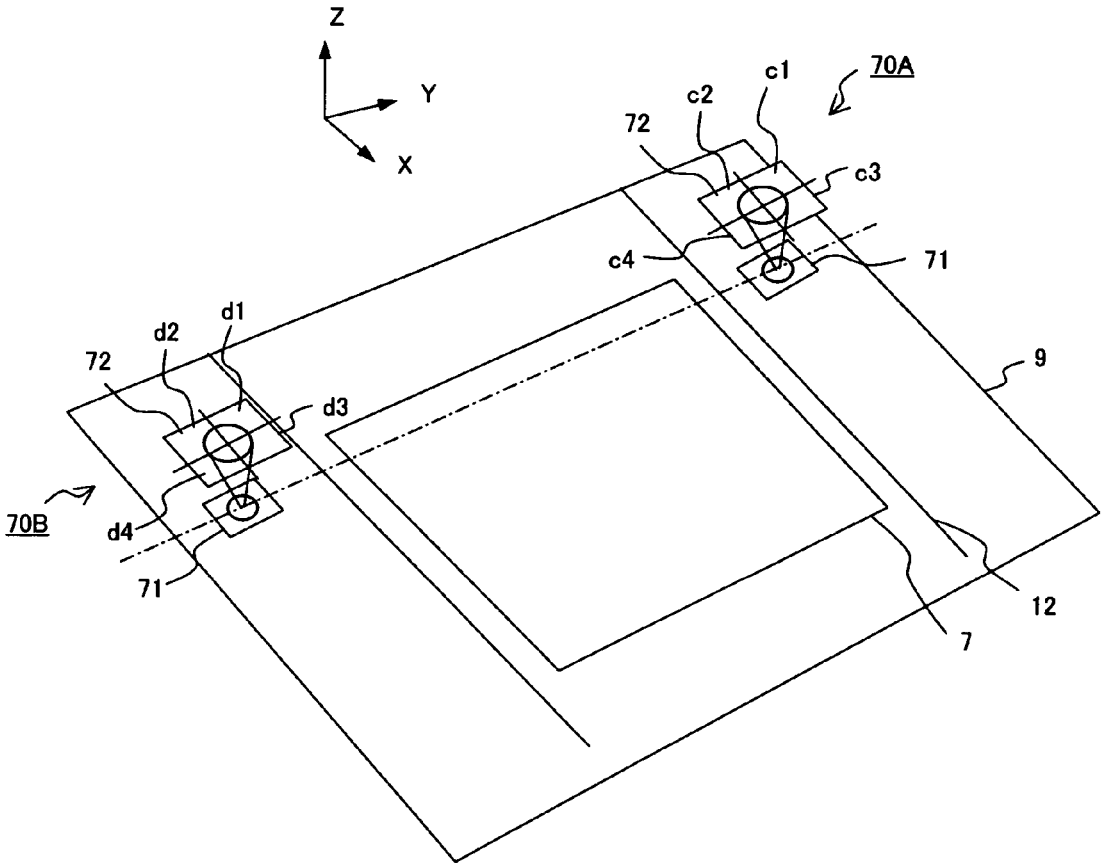
FIG. 12 shows a second embodiment.
Figure 13:
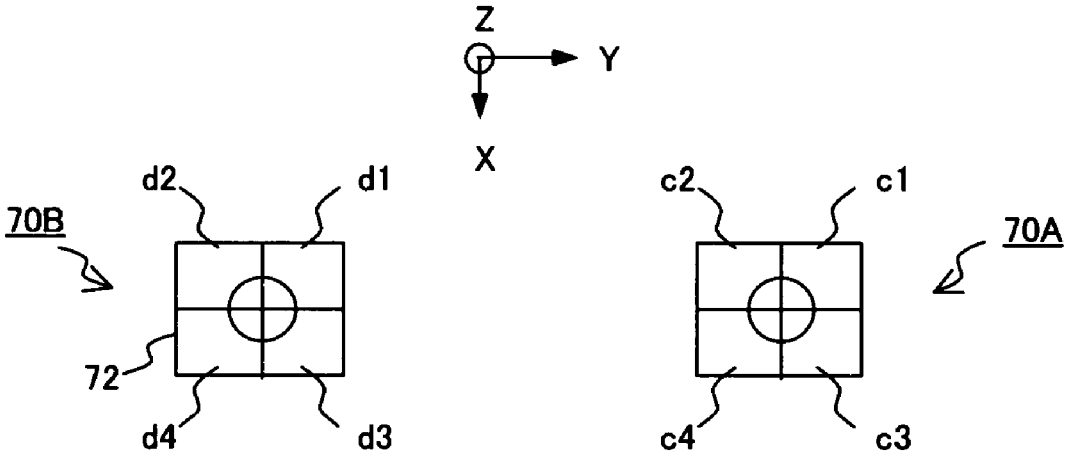
FIG. 13 shows a placement of a light receiving element with the light receiving surface being divided into four parts in parallel with X and Y axes, respectively.

The present embodiment uses sensors 70A and 70B as shown by FIG. 12; and is configured to place an LED 71 on the belt platen 9 and places on the carriage 8 a light receiving element 72 whose light receiving surface is divided into four parts in parallel with the X and Y axis directions as shown by FIG. 13, instead of not using the reflection target. Each light receiving surface is separately disposed by c1, c2, c3 and c4 as light receiving elements 72 of the sensor 70A; and is separately disposed by d1, d2, d3 and d4 as light receiving elements 72 of the sensor 70B.

Each of the light receiving surfaces c1 through c4, and d1 through d4, outputs each electric signal c1*e*, c2*e*, c3*e*, c4*e*, d1*e*, d2*e*, d3*e* and d4*e* respectively by receiving light from the LED 71. The configuration may be such that an inclination around the Z axis direction, a position in the X axis direction and that in the Y axis direction are calculated (NB: the calculation method may be by using an operational amplifier, a CPU, et cetera, rather than a specific method) according to the expression as described below based on the above noted electric signals, thereby enabling a detection of the relative position and angle of the belt platen 9 relative to the carriage 8 in the three directions. The below noted three position or angle information may be normalized by dividing by the total outputs (i.e., c1$e$+c2$e$+c3$e$+c4$e$+d1$e$+d2$e$+d3$e$+d4$e$) of the light receiving surfaces as in the case of the first embodiment.

Inclination around the Z axis=(c1$e$+c2$e$+d3$e$+d4$e$)−(c3$e$+c4$e$+d1$e$+d2$e$)

Position in the X axis direction=(c1$e$+c2$e$+d1$e$+d2$e$)−(c3$e$+c4$e$+d3$e$+d4$e$)

Position in the Y axis direction=(c1$e$+c3$e$+d1$e$+d3$e$)−(c2$e$+c4$e$+d2$e$+d4$e$)

A color shift can be corrected by detecting the inclination around the Z axis as in the case of the first embodiment.

For instance, if the belt platen 9 moves in the X axis direction due to an external vibration, et cetera, the color of each ink in the transport direction shifts in the X axis direction, which is detected by a positional shift of the belt platen 9 in the X axis direction and the ink ejection timing of each ink head is controlled by the amount of the aforementioned positional shift, thereby enabling a reduction of color shifts.

Furthermore, if the belt platen 9 moves in the Y axis direction due to an external vibration, et cetera, the color of each ink in the transport direction shifts in the Y axis direction, which is also detected by a positional shift of the belt platen 9 in the Y axis direction, thereby inputting, to each ink head for a control, an ejection position of each ink head relative to a specific image in the direction of the nozzle column as ejection information which shifts by a predetermined number of nozzles and reduces a color shift.

The above described comprisal makes it possible to simplify the configuration by requiring no reflection target. Also, it is possible to detect not only the radial shift but also the positional shift in the X and Y axes directions between the carriage 8 and belt platen 9, hence allowing a use for correcting a color shift.

Note that the light receiving element 72 may be placed on the belt platen 9, while the LED 71 may be placed on the carriage 8.

Third Embodiment

Figure 14:
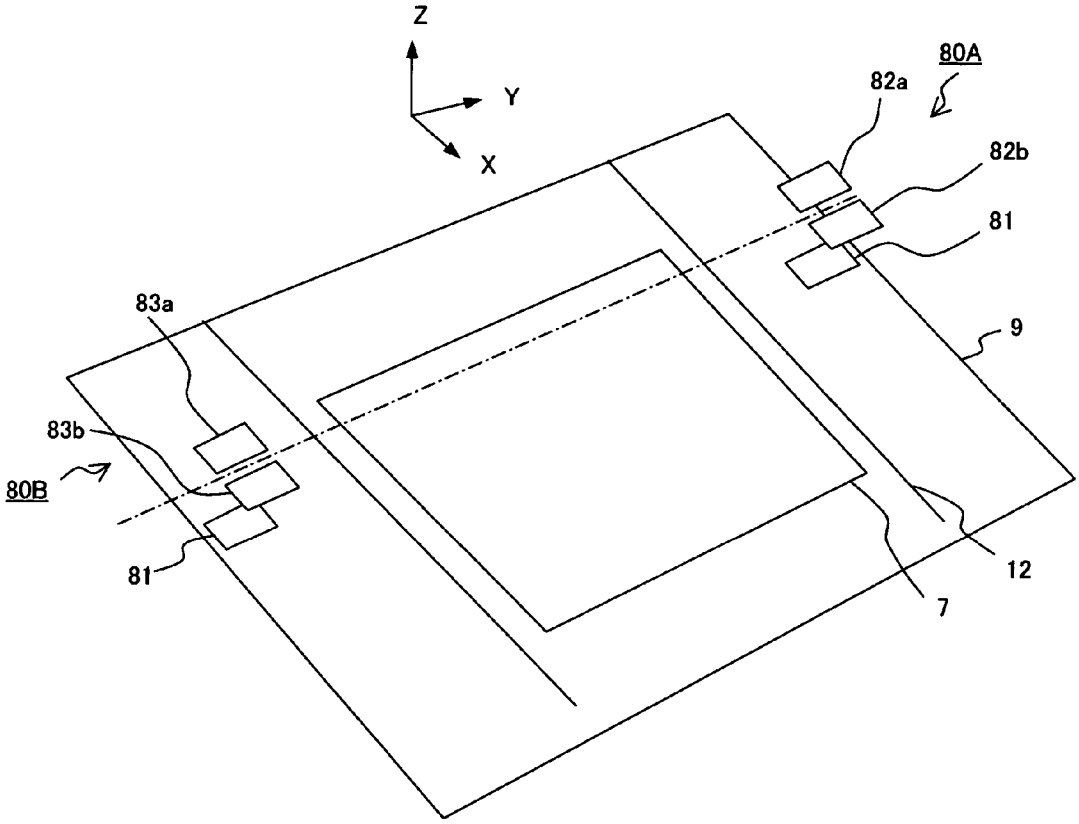
FIG. 14 shows a positional relationship of a Hall element.
Figure 15:
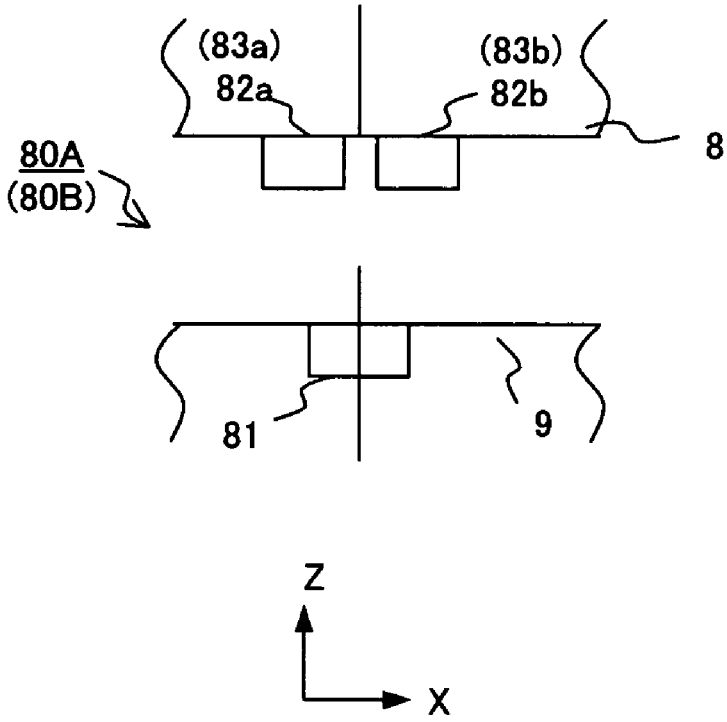
FIG. 15 shows a positional relationship of a Hall element.

The next description is of a third embodiment according to the present invention by referring to FIGS. 14 and 15. Note that the following description omits parts of the same comprisal as the first embodiment and only describes those parts that are different.

FIGS. 14 and 15 show a positional relationship of a magnet 81, i.e., a magnetic member, and each Hall element (i.e., magnetic sensor). Each of sensors 80A and 80B is constituted by one magnet 81 placed on the belt platen 9 and two Hall elements 82$a$ and 82$b$, or two Hall elements 83$a$ and 83$b$, respectively, which are placed on the carriage 8 and arrayed in the X axis direction. And an inclination is detected by utilizing a difference in the magnetic field distribution of the magnet 81 at the positions of respective Hall elements.

Figure 16:
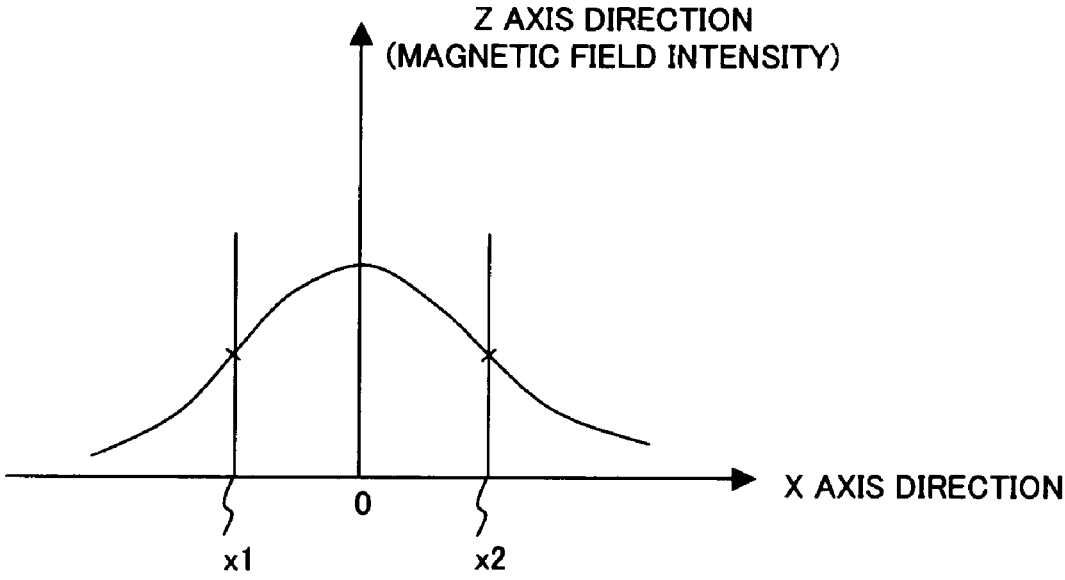
FIG. 16 shows positions of x1 and x2 of a magnetic field distribution of a magnet.

Specifically, each of the Hall elements 82$a$ (i.e., x1 position) and 82$b$ (i.e., x2 position), and 83$a$ (i.e., x1 position) and 83$b$ (i.e., x2 position), is respectively placed at the positions x1 and x2 of the magnetic field distribution of the magnet 81, which is shown by FIG. 16, at the Hall elements 82$a$, 82$b$, 83$a$ and 83$b$, which are mounted at one determined distance in the Z axis direction. The aforementioned magnetic field distribution is in terms of the X axis direction at the mounting position of the aforementioned Hall elements in the Z axis direction.

Therefore, the inclination information can be figured out by calculating an expression, i.e., (82$ae$+83$be$)−(82$be$+83$ae$), based on an output (i.e., an electric signal corresponding to a magnetic field intensity), i.e., 82$ae$, 83$be$, 82$be$ and 83$ae$, of each of the above described Hall elements.

Note that the each Hall element may be placed on the belt platen 9, while the magnet 81 may be placed on the carriage 8.

Note also that other magnetic field detection sensors may be used in lieu of the Hall elements that are used in the above description.

The present embodiment provides a benefit of the inclination information being uninfluenced by an ink contamination or paper dust because it does not employ light.

Fourth Embodiment

Figure 17:
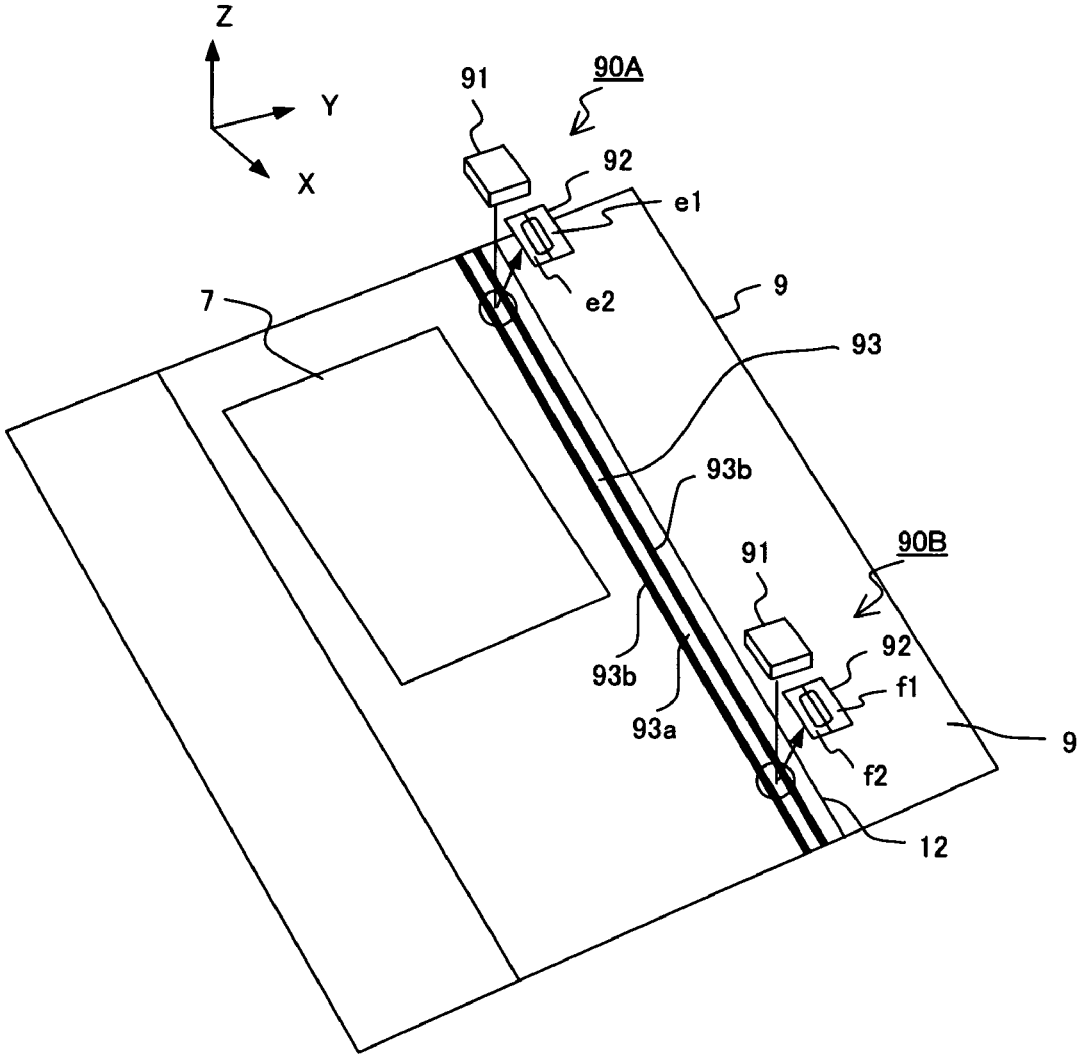
FIG. 17 shows a fourth embodiment.
Figure 18:
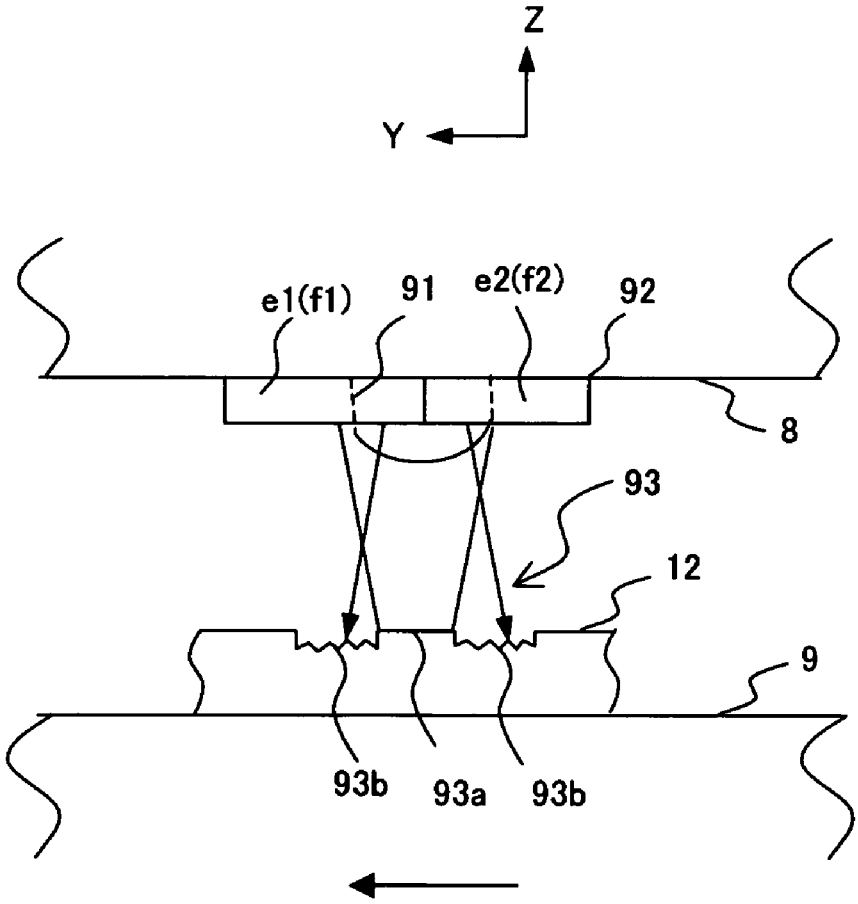
FIG. 18 shows how the light emitted by a light source is projected onto a reflection target and an intense reflected light from a reflection part is incident on a light receiving element.

FIGS. 17 and 18 show a fourth embodiment according to the present invention. The following description concerns the fourth embodiment. Note that the following description omits parts of the same comprisal as those of the first embodiment and only describes parts that are different. The present embodiment is configured to detect a skew of the belt 12 relative to the carriage 8.

Sensors 90A and 90B are placed toward one end of the belt 12 in the Y axis direction, and apart from each other in the X axis direction. A reflection target 93 is featured, as the target, toward one side in the Y axis direction, and on the entire circumference, of the belt 12. At the center is featured a high reflectivity part 93$a$ with a high reflectance ratio, while at the both sides is featured a low reflectivity part 93$b$ of a low reflectance ratio.

An LED 91 and light receiving element 92 whose light receiving surface is divided into two parts in the Y axis direction are placed on the carriage 8 so as to be arrayed in the X axis direction. The light receiving element 92 placed on the side of the sensor 90A is divided into an e1 and e2, while that of the sensor 90B is divided into an f1 and f2. Each of the light receiving element outputs an electric signal e1$e$, e2$e$, f1$e$ and f2$e$ according to a received light amount.

As shown by FIG. 18, the light emitted from the LED 91 is projected onto the reflection target 93 and the strongly reflection light from the reflection part 93$a$ is incident on the light receiving element 92. A calculation based on the outputs of the divided light receiving element 92 by an expression, i.e., (e1$e$+f2$e$)−(e2$e$+f1$e$), figures out an inclination of the belt platen 9 relative to the carriage 8 around the Z axis, thereby enabling correction of a color shift as in the case of the first embodiment.

The present embodiment is configured to detect an inclination of the belt 12 directly transporting the recording medium 7 in lieu of a stationary part of the belt platen 9 and therefore a detection error is not caused if a differential inclination between a stationary part of the belt platen 9 and the belt 12 occurs, hence making it possible to obtain a skew of the recording medium 7 relative to the carriage 8 with a high accuracy and accordingly improve a correction accuracy.

It is also possible to detect a skew by a magnetic sensor, instead of an optical sensor, if the belt 12 is printed with a magnetic body a lá stripe. This configuration provides a benefit of the inclination information being uninfluenced by an ink contamination or paper dust because it does not employ light.

Figure 19:
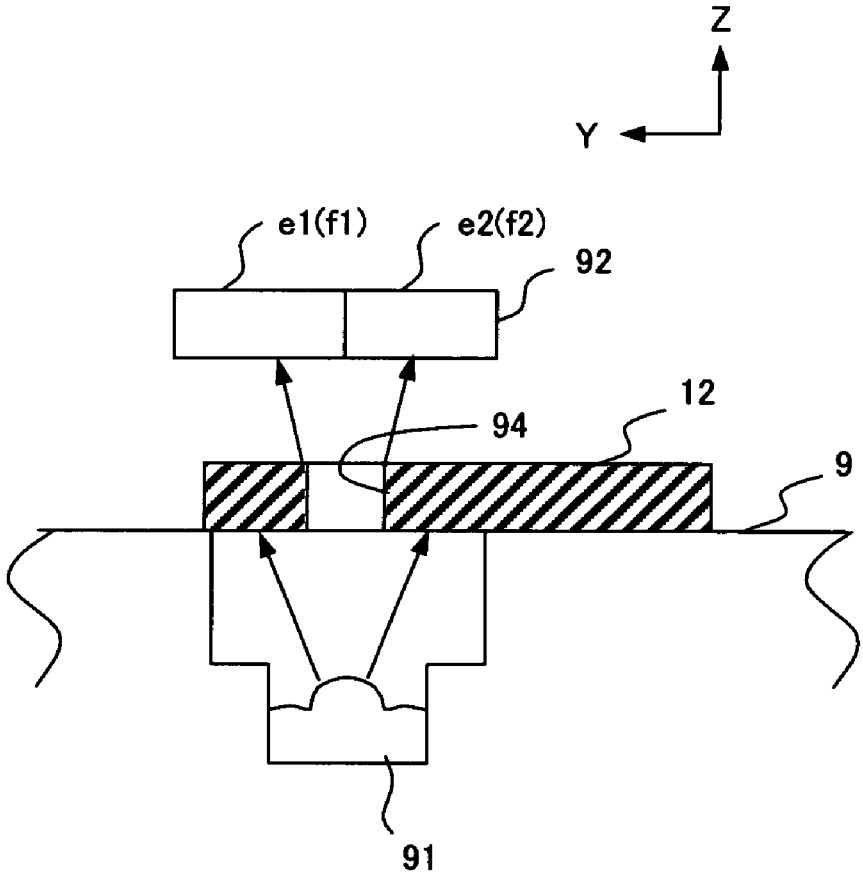
FIG. 19 shows a position for a light receiving element receiving light after the light emitted from the light source passes through an aperture.

As shown by FIG. 19, placing an LED 91 on the stationary part of the belt platen 9, opening a plurality of holes 94 which are continuously arrayed linearly along the X axis direction of the entire circumference of the belt 12 and projecting the light onto the light receiving element 92 through the holes 94 make it possible to detect a skew in a similar way, since the light passing through the hole 94 moves in the Y axis direction on the light receiving element 92 according to a position of the belt 12 in the Y axis direction.

Incidentally, if a material of a belt 12 is highly transparent to light from a light source, a use of a plurality of circular light transmission parts with different transmission ratios which are arrayed linearly, or a continuous light transmission part a lá stripe, instead of the holes 94, provides the same function.

Fifth Embodiment

Figure 20:
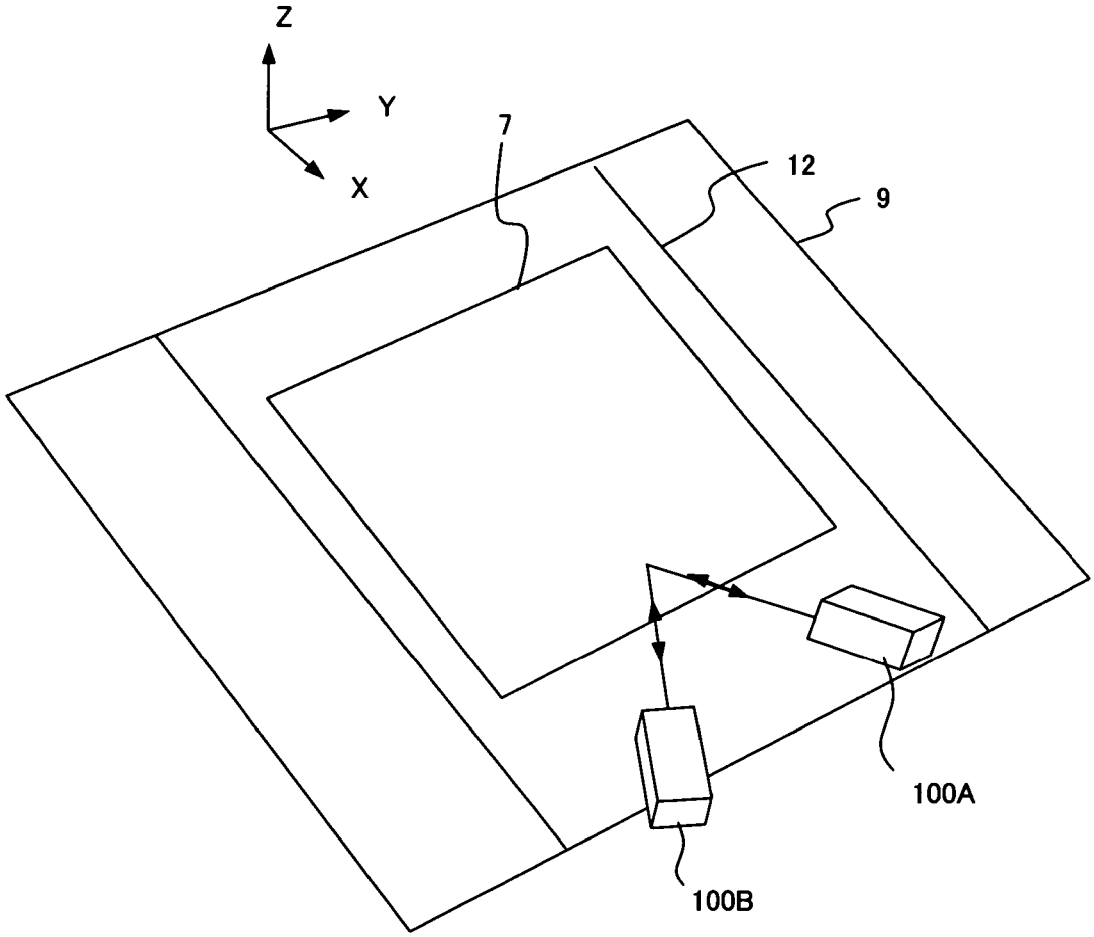
FIG. 20 shows a fifth embodiment.

FIG. 20 shows a fifth embodiment according to the present invention. The following description concerns the fifth embodiment. Note that the following description omits parts of the same comprisal as those of the first embodiment and only concerns those parts that are different. The present embodiment is configured to detect a transport direction of a recording medium directly by a sensor.

Figure 21:
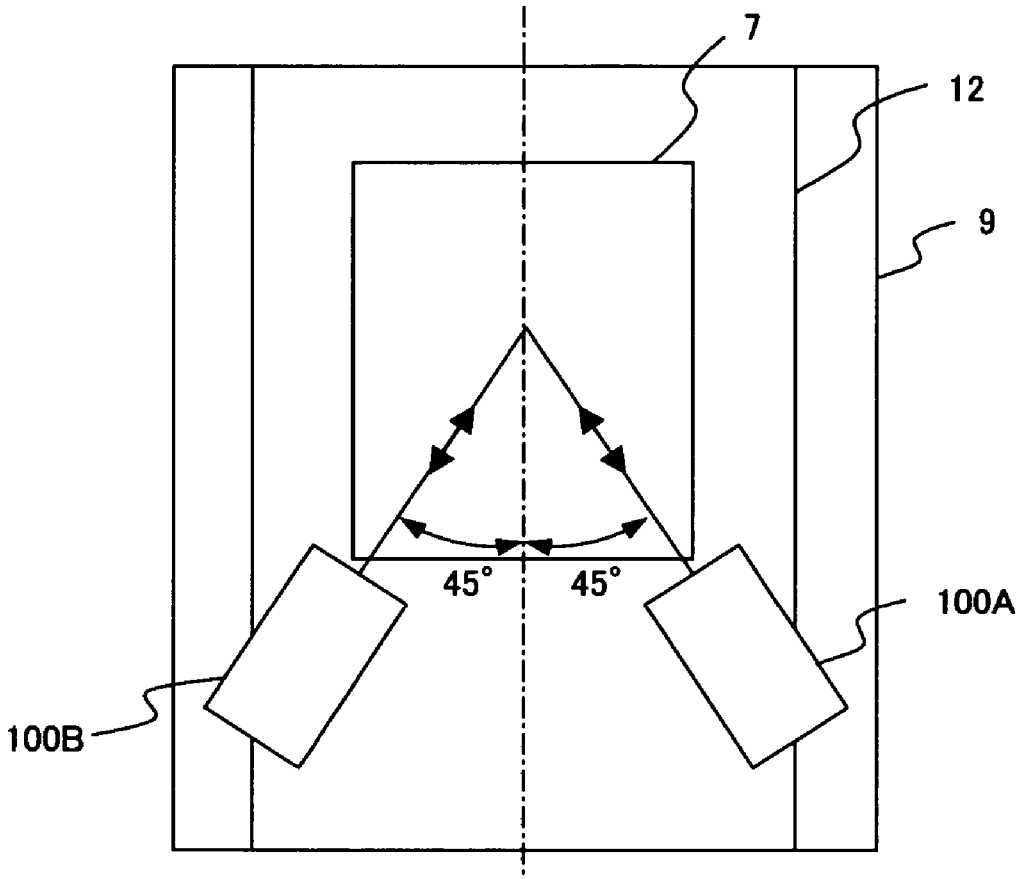
FIG. 21 shows an example of a sensor position according to the fifth embodiment.

The carriage 8 is equipped by two laser Doppler measurement equipments (i.e., optical velocity sensors) 100A and 100B with the respective optical emission axes being angled 45 degrees at the center of the belt 12 in the Y axis direction so as to measure the transport speed of the recording medium 7 approximately linearly as shown by FIG. 21.

Figure 22:
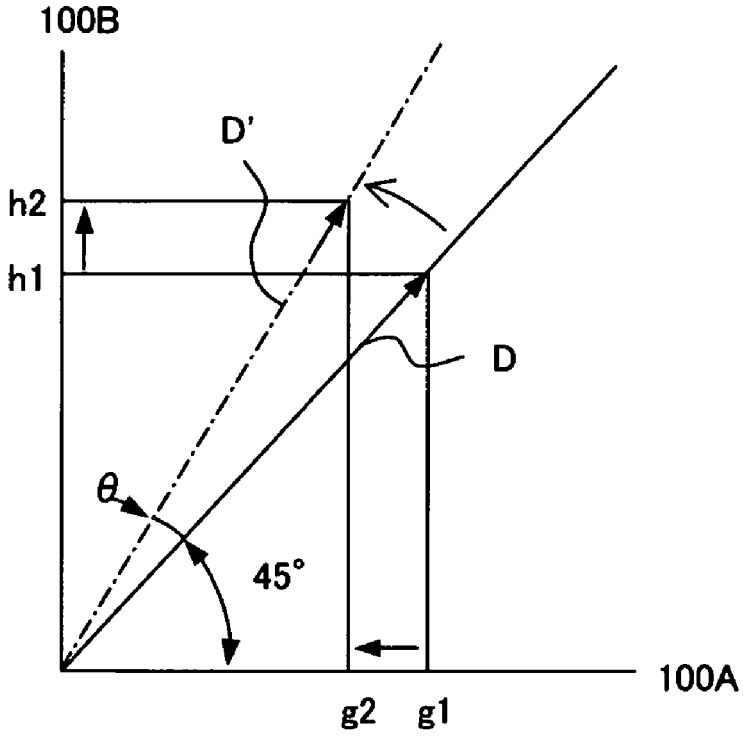
FIG. 22 shows a graph employed when calculating an inclination by the fifth embodiment.

By such a configuration, if the transport direction of the recording medium 7 is parallel with the Y axis, the arrow D shown by FIG. 22 results, thus the laser Doppler measurement equipments 100A and 100B respectively detect components parallel with the respective optical emission axes of the transport speed of the recording medium 7, hence outputting the same speed information as g1 and h1, respectively.

On the other hand, if the transport direction of the recording medium 7 inclines by an angle θ from the Y axis to become the arrow D', then the outputs from the laser Doppler measurement equipments 100A and 100B decrease/increase to g2 and h2, respectively.

Therefore the transport direction of the recording medium can be detected directly by calculating the difference of the respective outputs of the laser Doppler measurement equipments 100A and 100B.

The present embodiment is configured to detect the transport direction of the recording medium directly, and therefore provide a high detection accuracy without a detection error being caused if there is a displaced inclination between the belt platen 9 and belt 12, or a slippage between the belt 12 and recording medium 7.

Figure 23:
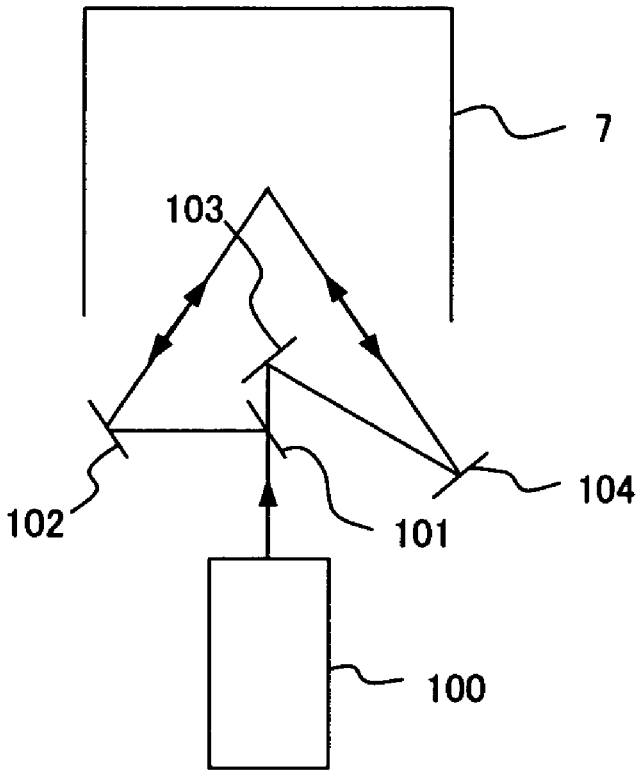
FIG. 23 shows an optical system in the case of measuring by changing over light paths.

While the present embodiment uses two laser Doppler measurement equipments, one such equipment may be used by switching as shown by FIG. 23. The light emitted from the laser Doppler measurement equipment 100 is incident on an LC (liquid crystal) shutter 101. And when the LC shutter 101 reflects light, the light is projected to the recording medium 7 by way of the mirror 102. Meanwhile, when the LC shutter 101 transmits light, the light is projected to the recording medium 7 by way of mirrors 103 and 104.

Switching the LC shutter 101 in a short time makes it possible to detect a speed from two directions by time sharing with only one laser Doppler measurement equipment, thereby reducing a cost of the configuration.

Note that while the present embodiment measures the speed of a recording medium, the speed of a belt may be detected. In such a case, a stable inclination information can be obtained if reflectance ratios, et cetera, change due to kinds of recording media. Naturally such detection is carried out by projecting light through the gap between transported recording media or on an end of a belt outside the width of the recording medium in the Y axis direction.

Sixth Embodiment

Figure 24:
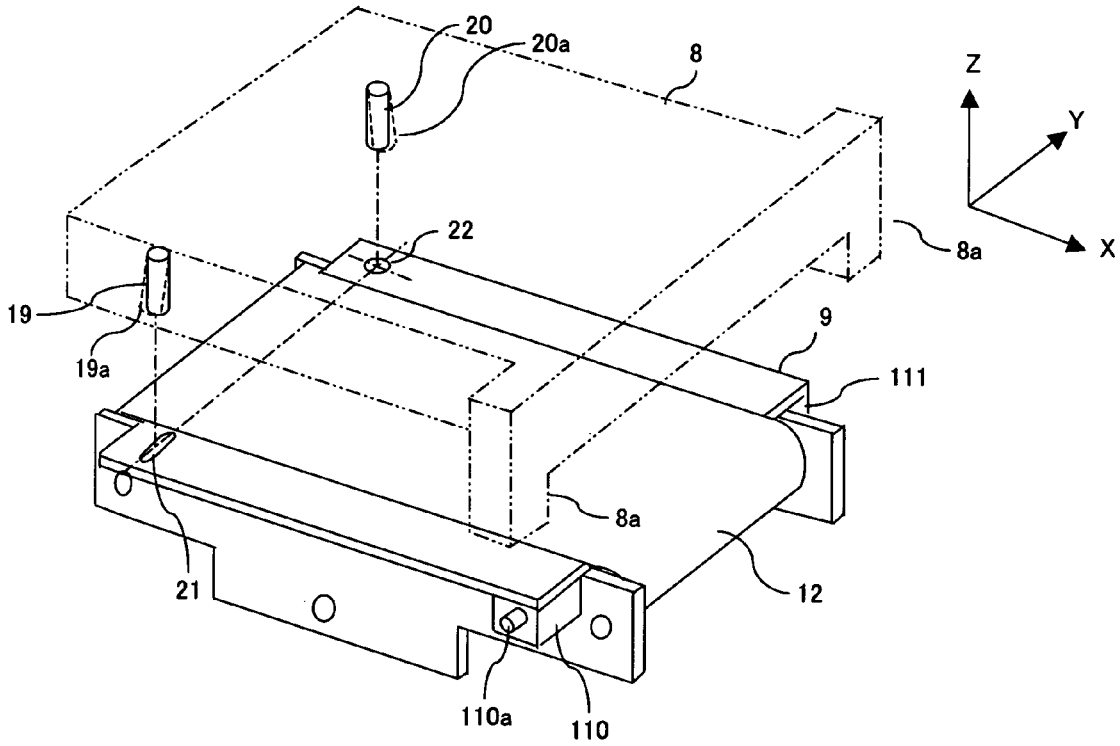
FIG. 24 shows a sixth embodiment.
Figure 25:
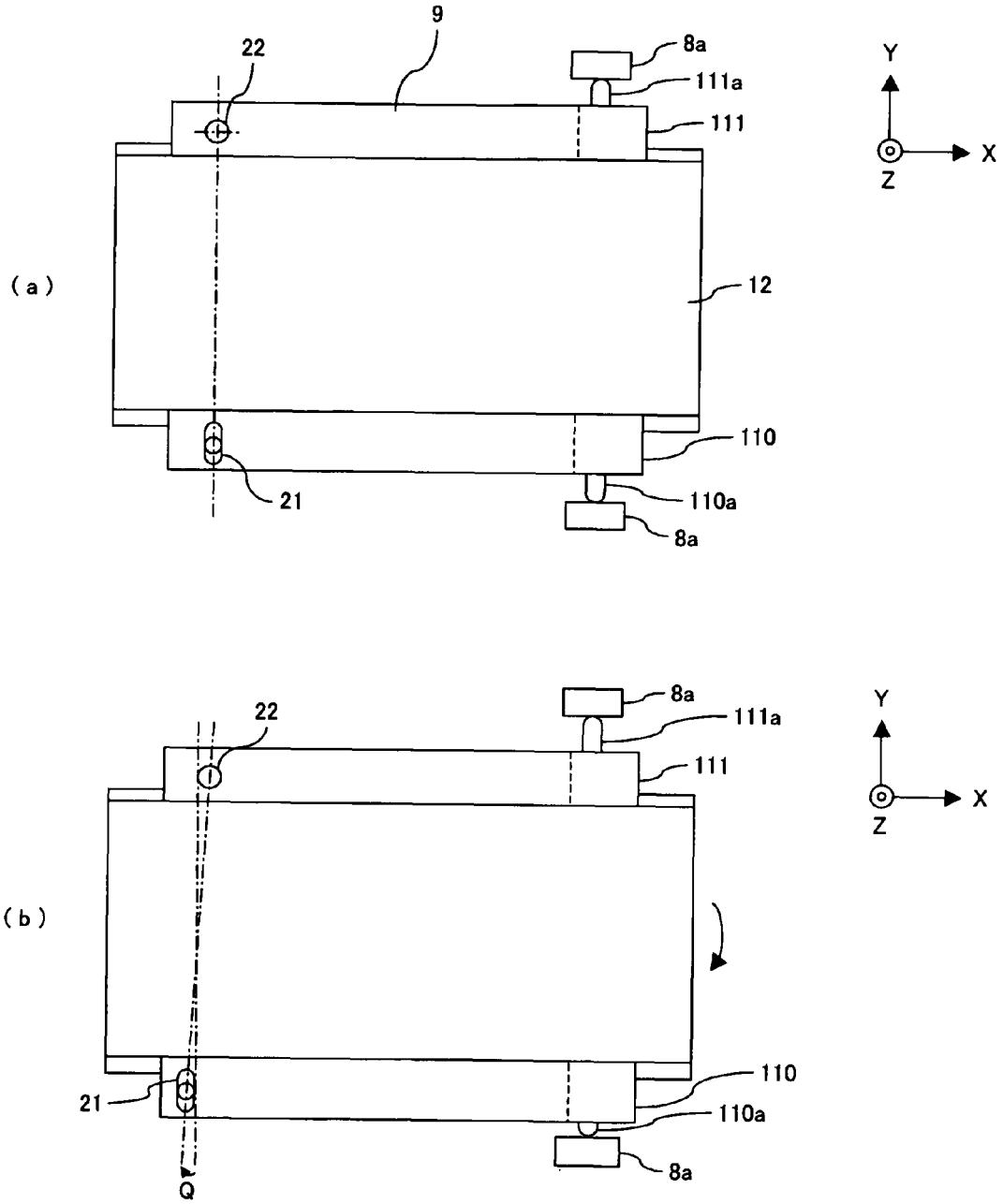
FIG. 25 shows the sixth embodiment, with (a) showing the case of no inclination of a belt platen around the Z axis relative to a carriage, and (b) showing a drawing showing a shortening of a protrusion of one motor driven cylinder and a lengthening of a protrusion of a cylinder from another cylinder.

FIGS. 24 and 25 show a sixth embodiment. The following description concerns the sixth embodiment. Note that the following description omits parts of the same comprisal as those of the first embodiment and only concerns those parts that are different. The same functions are assigned by the same component numbers.

The present embodiment is configured to use deformations of two carriage pins 19 and 20, and two motor driven cylinders 110 and 111 as an inclination drive mechanism of the belt platen 9. Positioning holes 21 and 22 are equipped at respective corresponding positions of the stainless steel carriage pins 19 and 20 on the belt platen 9. The positioning hole 21 is featured fixed with respect to the belt platen 9 as an elongated hole with the long side approximately along the Y axis direction, while a moving mechanism a lá the first embodiment is not comprised. The positioning hole 22 is disposed for inserting the carriage pin 20 and featured as a circular hole as in the case of the first embodiment. The motor driven cylinders 110 and 111 are placed at the both ends in the Y axis direction, and at the X (positive) end, of the belt platen 9. The motor driven cylinders 110 and 111 have the same comprisal. The motor driven cylinders 110 and 111 have cylinders 110*a* and 111*a*, respectively, which move linearly in the extended direction, respectively.

Protrusions 8*a* and 8*a* protruding in the Z axis (negative) direction, on the both sides of the Y axis direction and in the X axis (positive) direction of the carriage 8 are featured.

When the belt platen 9 is in the image forming position, the tips of the cylinders 110*a* and 111*a* are in contact with the protrusions 8*a* and 8*a*, respectively. The sensors 60A and 60B (not shown here) are placed for detecting an inclination of the belt platen 9 relative to the carriage 8 around the Z axis as with the first embodiment.

FIG. 25 (*a*) shows the case of no inclination of the belt platen 9 around the Z axis relative to the carriage 8. In this state, the tips of the respective cylinders 110*a* and 111*a* of the motor driven cylinders 110 and 111 protrude by the same lengths and contact with the protrusions 8*a* and 8*a*, respectively. If the belt platen 9 is to be inclined relative to the carriage 8 around the Z axis, the protruding length of the cylinder 110*a* of the motor driven cylinder 110 is shortened while that of the cylinder 111*a* of the motor driven cylinder 111 is lengthened as shown by FIG. 25 (*b*). Then, receiving a rotational torque around the Z axis against the protrusions 8*a* and 8*a*, the belt platen 9 is inclined relative to the carriage 8 around the Z axis as a result of the tips of the carriage pins 19 and 20 deformed in the reverse direction to the X axis direction as shown by the numerals 19*a* and 20*a* of FIG. 24.

The material, diameter and length of each of the carriage pins 19 and 20 are suitably selected so as to deform easily in the X axis direction by a torque around the Z axis generated by the motor driven cylinders 110 and 111.

A color shift can be reduced by correcting an inclination of the belt platen 9 relative to the carriage 8 around the Z axis by a signal from the sensors 60A and 60B (not shown here) for detecting an inclination of the belt platen 9 relative to the carriage 8 around the Z axis.

While the present embodiment is configured to let the motor driven cylinders 110 and 111 make contact with, and press against, the carriage 8, other parts fixed to the carriage 8, such as the first frames 1 and 2 may substitute for the carriage 8. Meanwhile, instead of the motor driven, linear action cylinder, a combination with a gear such as a rack and pinion is also possible.

The present embodiment is configured to utilize an elastic deformation of the carriage pin, i.e., a relative positioning member between the carriage 8 and belt platen 9, for the support mechanism for an inclination of the belt platen 9. This necessitates no moving mechanism 50 as with the first embodiment, hence simplifying the comprisal.

The present embodiment uses two stainless steel pins which have a circular cross section and deform elastically. Instead of being limited as described above, the material may be another metal such as a steel other than stainless steel, phosphor bronze, or plastic resin, hard elastomer, et cetera. Also, the pins may be featured with any configuration with a characteristic of elastic deformation, such as a rectangular cross-section and a circular cone.

Seventh Embodiment

Figure 26:
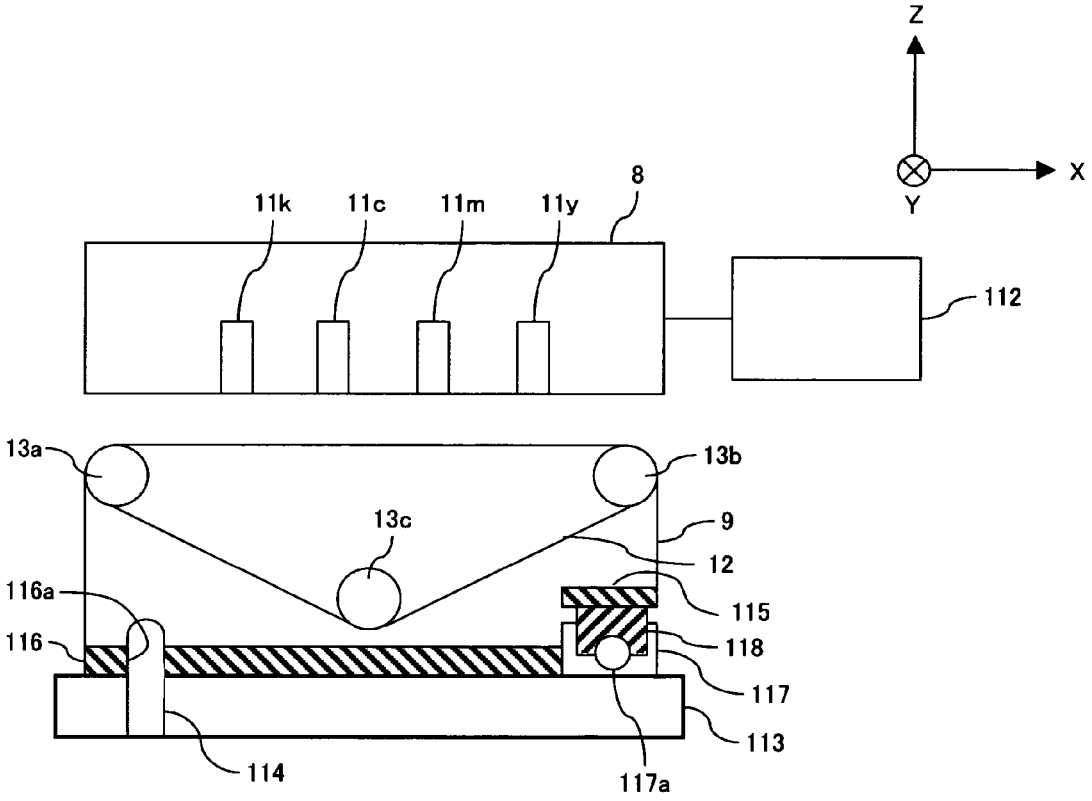
FIG. 26 shows a seventh embodiment.
Figure 27:
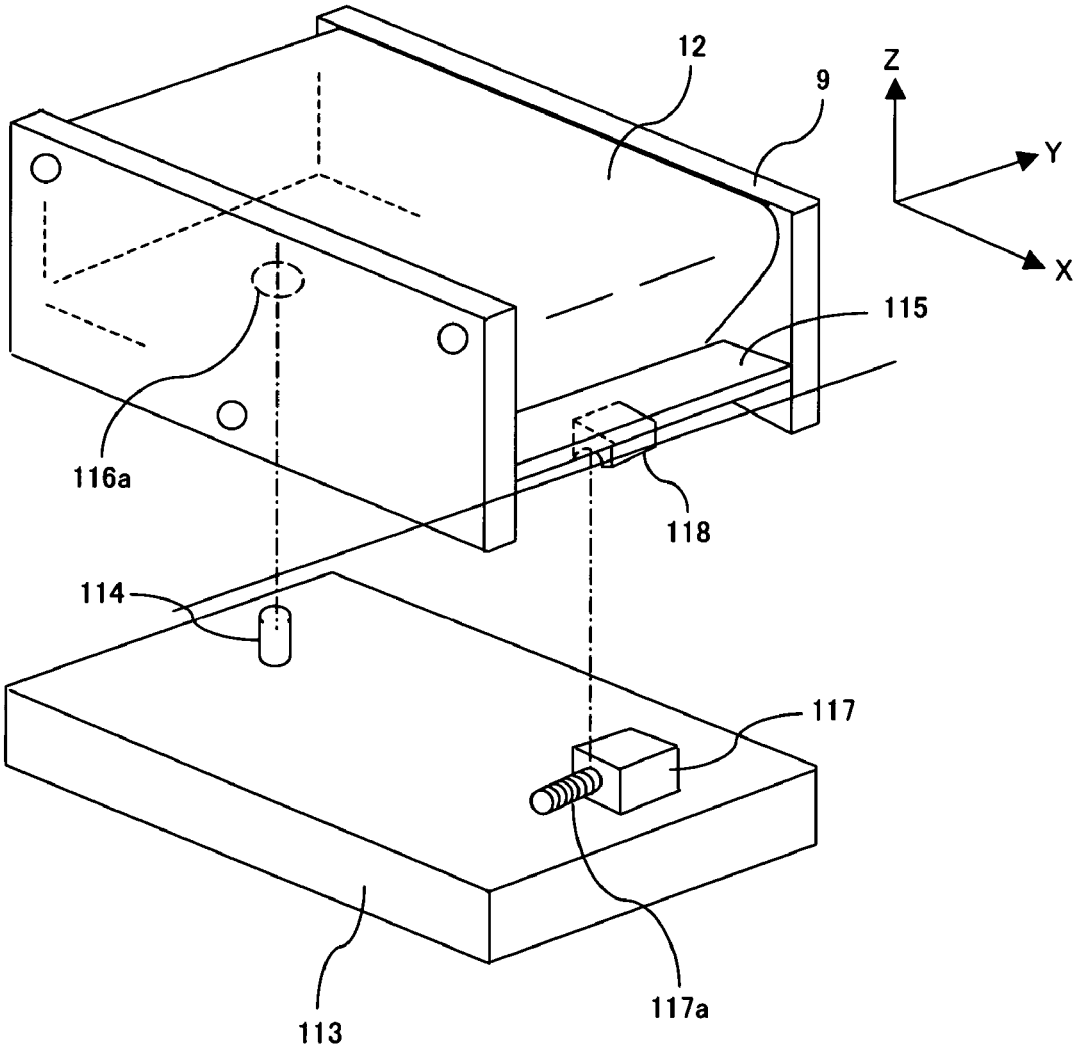
FIG. 27 shows the seventh embodiment.

FIGS. 26 and 27 show a seventh embodiment. The following description concerns the seventh embodiment. Note that the following description omits parts of the same comprisal as those of the first embodiment and only concerns those parts that are different. The same functions are assigned by the same component numbers.

The present embodiment is configured to make the belt platen 9 stationary instead of moving up or down (Z axis direction), with an up or down moving mechanism 112 being installed in the carriage 8 so that the carriage 8 moves up or down relative to the first frames 1 and 2 in the case of a maintenance operation, et cetera. The moving mechanism can be comprised by known means such as a slide rail, a drive motor and a gear.

A base plate 113 is fixed to the first frames 1 and 2. A pin 114 is fixed to the center on the X axis (negative) side of the base plate 113. A motor 117 with a rotating lead screw 117*a* is fixed to the center on the X axis (positive) side of the base plate 113.

A bottom plate 116 and a rib 115 are fixed on the Z (negative) side of the belt platen 9. The belt platen 9 is placed so that the bottom surface of the bottom plate 116 is free to slide on the top surface of the base plate 113. A positioning hole 116*a* is featured at a position corresponding to the pin 114 at the center of the X axis (negative) direction of the bottom plate 116, with the pin 114 being inserted rotationally into the positioning hole 116*a*. And a female screw 118, which is cut a lá half nut so as to mate with the lead screw 117*a*, is fixed at the center of the rib 115 which is placed on the X axis (positive) side of the belt platen 9.

By such a comprisal, the belt platen 9 is structured so as to rotate relative to the base plate 113 around the Z axis with the pin 114 as the center.

Also, the belt platen 9 is rotationally driven relative to the base plate 113 around the Z axis with the pin 114 as the center by letting the female screw 118 move in the Y axis direction relative to the motor 117 as a result of rotating the lead screw 117*a* of the motor 117.

The above described configuration makes it possible to correct an inclination of the belt platen 9 relative to the carriage 8 around the Z axis without directly positioning the belt platen 9 and carriage 8, thereby reducing a color shift.

Eighth Embodiment

Figure 28:
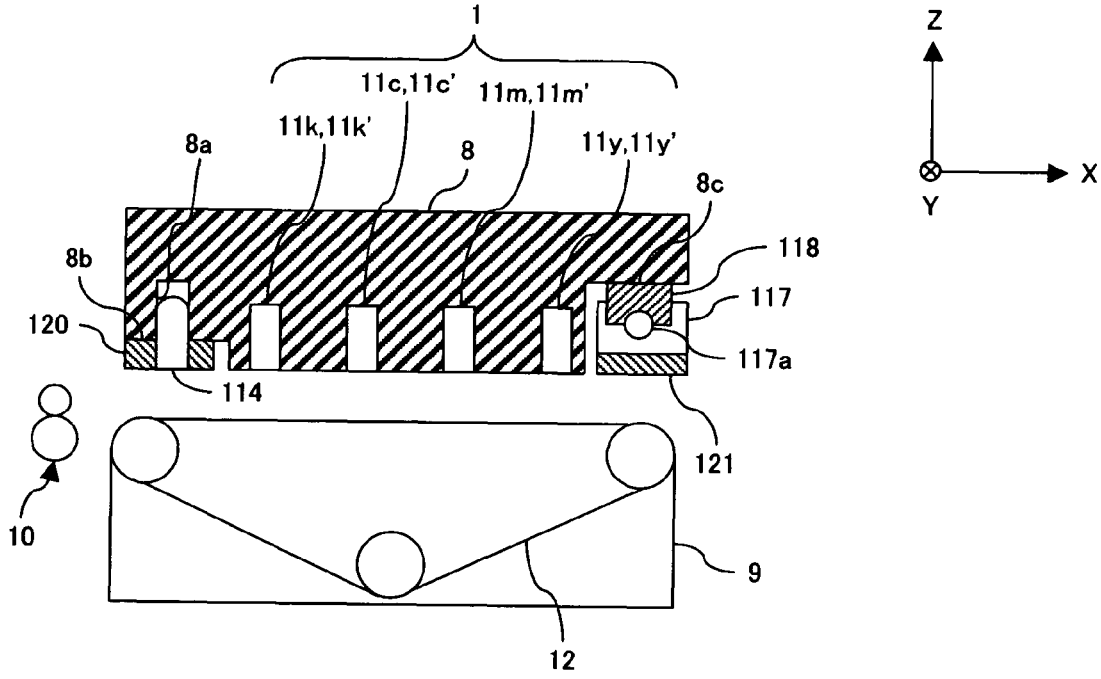
FIG. 28 shows an eighth embodiment.
Figure 29:
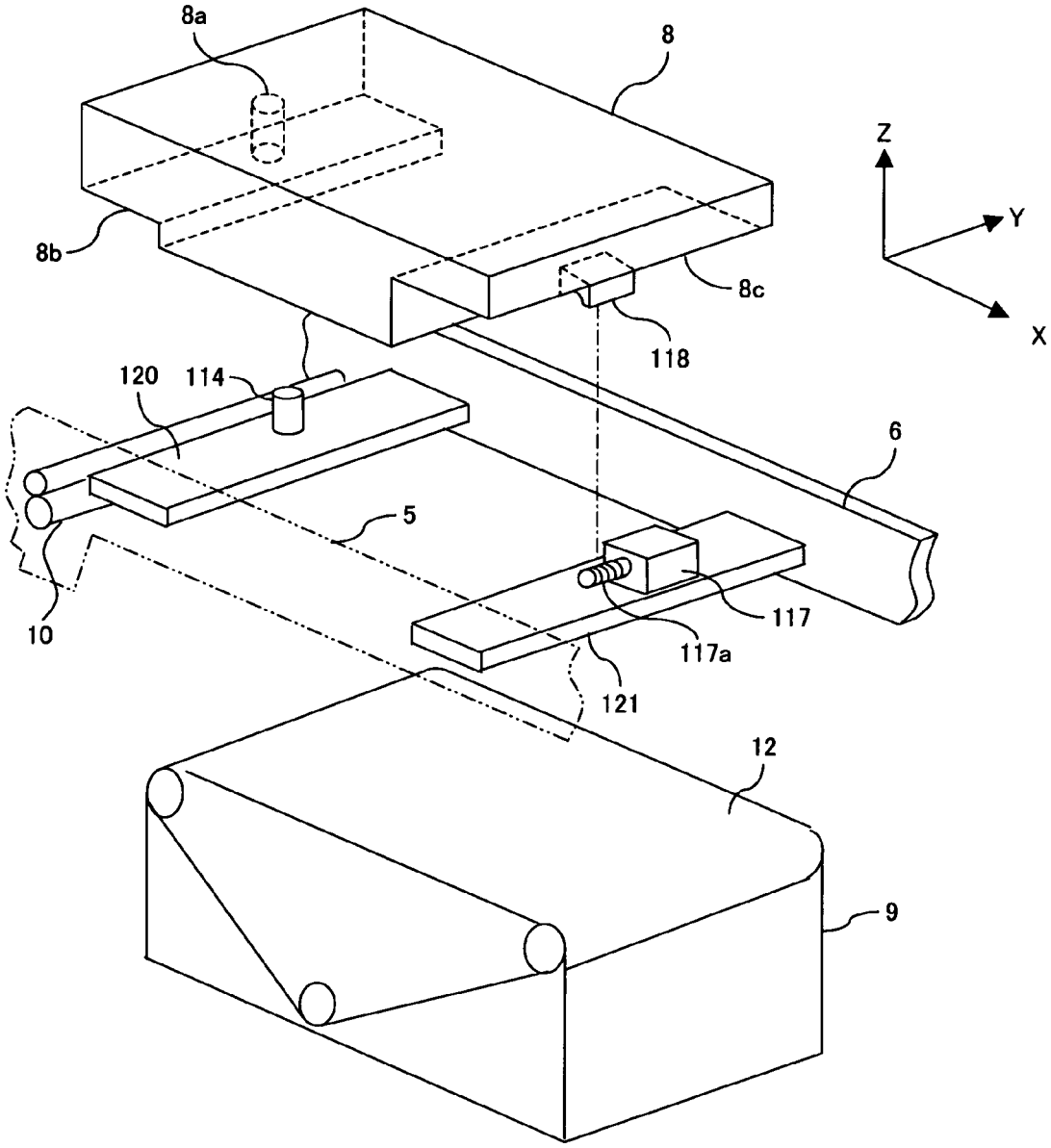
FIG. 29 shows the eighth embodiment.

FIGS. 28 and 29 show an eighth embodiment. The following description is concerned with the eighth embodiment. Note that the following description omits parts of the same comprisal as those of the first and seventh embodiment and only concerns those parts that are different. The same functions are assigned by the same component numbers.

The present embodiment is configured so that the belt platen 9 moves up or down (in the Z axis direction) as in the first embodiment. Meanwhile, the belt platen 9 is not structured to incline relative to the first frames 1 and 2 around the Z axis, but the carriage 8 is structured to incline around the Z axis.

Connection frames 120 and 121 are fixed so as to connect the connection frames 5 and 6 in the Y axis direction.

A pin 114 is fixed at the center in the Y axis direction of the connection frame 120. A motor 117 with a rotational lead screw 117*a* is fixed at the center in the Y axis direction of the connection frame 121.

A contact surface 8*b* is featured on the bottom face on the X axis (negative) side of the carriage 8, with a positioning hole 8*a* being featured at the center in the Y axis direction and at the position corresponding to the pin 114. And a fixing surface 8*c* is formed on the bottom face on the X axis (positive) side of the carriage 8, with a female screw 118, which is cut a lá half nut so as to mate with the lead screw 117*a*, being fixed. The pin 114 is inserted into the positioning hole 8*a* and the contact surface 8*b* is mounted on the top surface of the connection frame 120 so as to be free to slide thereon.

The ends of the registration roller unit 10 are retained by the connection frames 5 and 6.

Such a comprisal configures the carriage 8 so as to be rotational relative to the connection frames 120 and 121, that is, the first frames 1 and 2 and the belt platen 9 around the Z axis with the pin as the center.

The carriage 8 is rotationally driven relative to the belt platen 9 around the Z axis with the pin 114 as the center by letting the female screw 118 move in the Y axis direction relative to the motor 117 as a result of rotating the lead screw 117*a* of the motor 117. Since the registration roller unit 10 is retained by the connection frames 5 and 6 so as to be integrated with the carriage 8 and not to rotate around the Z axis, a rotation of the carriage 8 around the Z axis does not change an inclination between the registration roller unit 10 and belt platen 9, hence transporting the recording medium 7 correctly.

The above described configuration corrects an inclination of the recording head 11 fixed onto the carriage 8 relative to the belt platen 9 around the Z axis, thereby enabling a reduction of color shift.

Since the present embodiment does not incline a transport mechanism, and therefore the configuration is preferable for an image forming apparatus on which a transport mechanism facing a recording head is difficult to incline such as one having a large scale transport mechanism relating to the recording head or one feeding a continuous paper by a paper roll.

While the present embodiment is configured to incline the carriage on which recording heads are fixed, a recording head may be inclined if a four-color ink head group is integrated as one recording head for example.

And, while the present embodiment is configured to place the drive unit of the inclination mechanism for inclining around the Z axis between the carriage and connection frame, it is also possible to place the drive unit of the inclination mechanism for inclining around the Z axis between the carriage and the belt platen as in the case of sixth embodiment.

And, while the present embodiment is configured to incline by rotating around one pin, it is also possible to configure by an elastically deforming pin which is placed between the carriage and belt platen, et cetera, as in the case of the sixth embodiment.

Ninth Embodiment

Figure 30:
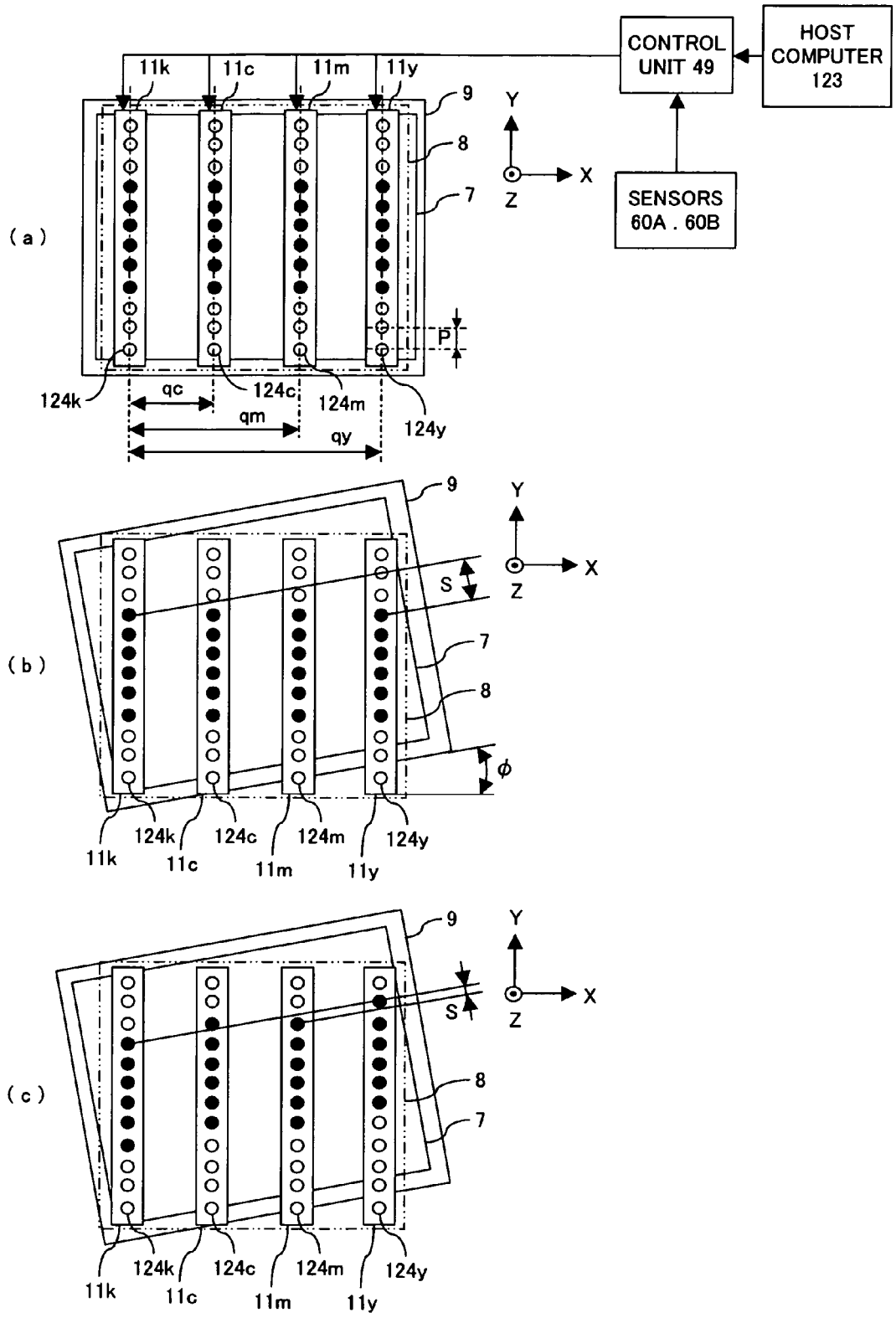
FIG. 30 shows a ninth embodiment, with (a) showing the case of no inclination of a belt platen around the Z axis relative to a carriage, (b) showing the case of an inclination of a belt platen around the Z axis relative to a carriage and of not correcting ejection information input to a ink head groups, i.e., a color shift not yet being corrected, and (c) showing the case of an inclination of a belt platen around the Z axis relative to a carriage and of correcting ejection information input to the ink head groups, i.e., a color shift having been corrected.

FIG. 30 shows a ninth embodiment. The following description concerns with the ninth embodiment. Note that the following description omits parts of the same comprisal as those of the first embodiment and only concerns those parts that are different. The same functions are assigned by the same component numbers.

The present embodiment is configured to have no moving mechanism 50 and not let the belt platen 9 be inclined relative to the recording heads 11, vis-à-vis the first embodiment. The present embodiment is configured to correct ejection information in lieu of correcting an inclination mechanically, thereby correcting a color shift due thereto.

As shown by FIG. 30 (*a*), an inclination information obtained from outputs of the sensors 60A and 60B, which is for detecting the inclination of the belt platen 9 relative to the carriage 8 around the Z axis as in the case of the first embodiment, is made to input to the control unit 49. And image information from a host computer 123 is sent to the control unit 49, ejection information is created, the ejection information is input to the respective ink head groups 11*k*, 11*c*, 11*m* and 11*y*, and ink is ejected from each nozzle 124*k*, 124*c*, 124*m* and 124*y* of the respective ink head groups 11*k*, 11*c*, 11*m* and 11*y* onto the recording medium 7. Note that FIG. 30 shows the ink head groups 11*k*, 11*c*, 11*m* and 11*y* having one nozzle column for each by simplifying the respective ink head groups 11*k*, 11*k*', 11*c*, 11*c*', 11*m*, 11*m*', 11*y* and 11*y*'. FIG. 30 shows an example of ink ejection from the respective nozzles 124*k*, 124*c*, 124*m* and 124*y* by black circles for nozzles ejecting and white circles for nozzles not ejecting.

FIG. 30 (*b*) shows the case of the belt platen 9 inclined at an angle ϕ around the Z axis. In this case, since the recording medium 7 is transported by the inclined belt platen 9, the position of the yellow ink ejected onto the recording medium 7 ejected from the most downstream ink head row 11*y* vis-à-vis that of the black ink ejected onto the recording medium 7 ejected from the most upstream ink head row 11*k* has the maximum color shift S in the width direction of the recording medium 7 thereon.

Let the distance qc between the nozzles 124*k* and 124*c* in the X axis direction, the distance qm between the nozzles 124*k* and 124*m* in the X axis direction, the distance qy between the nozzles 124*k* and 124*y* in the X axis direction, and the array pitch "p" of each nozzle in the Y axis direction be defined. The control unit 49 calculates the below noted displacement amounts rc, rm and ry. Each value of the displacement amounts rc, rm and ry is an integer rounded to a whole number after the decimal point.

$$rc=(qc*\tan\Phi)/p$$

$$rm=(qm*\tan\Phi)/p$$

$$ry=(qy*\tan\Phi)/p$$

The control unit 49 creates ejection information by displacing an ejection nozzle position by the displacement amount of rc in the nozzle row direction for inputting the ejection information to the ink head group 11*c*; and likewise, creates ejection information by displacing an ejection nozzle position by the displacement amount of rm in the nozzle row direction for inputting the ejection information to the ink head group 11*m*; and creates ejection information by displacing an ejection nozzle position by the displacement amount of ry in the nozzle row direction for inputting the ejection information to the ink head group 11*y*. FIG. 30(*c*) shows the state of ejection information being input for each ink head group 11*c*, 11*m* and 11*y* in the case of correction of the displacement amounts of rc=1, rm=1 and ry=2.

The above described configuration makes it possible to reduce a displacement of each color ink ejected onto the recording medium 7 in the Y axis direction down to no more than half the nozzle pitch by displacing ejection information input to the recording head 11 by a predetermined amount in the nozzle row direction according to an inclination, if the belt platen 9 is inclined relative to the carriage 8, that is, the recording head 11, around the Z axis.

It is desired that the maximum nozzle row width in the Y axis direction of the respective nozzles 124*k*, 124*c*, 124*m* and 124*y* of the respective ink head groups 11*k*, 11*c*, 11*m* and 11*y* be larger than the maximum printing width according to the predicted maximum displacement amount of the ejection nozzles.

The present embodiment makes it possible to correct a color shift in the Y axis direction without mechanical means for correcting a relative inclination between the carriage 8 and belt platen 9 around the Z axis, and therefore comprise a low cost, compact image forming apparatus.

Note that the present embodiment is configured to determine a displacement amount of ejection nozzles of the respective nozzles 124*c*, 124*m* and 124*y* with the black nozzle 124*k* as the reference position. However, it is possible to employ another position as the reference position such as the centers of the nozzles 124*c* and 124*m*, or other nozzles such as 124*y*, or other positions far therefrom.

The following configuration may be appropriate in stead of being limited by the above described embodiments. The inclination correction unit below is not limited as such.

And, the inclination mechanism of the carriage and belt platen is not specifically limited as described above but rather an inclination mechanism with various drive mechanisms such as a piezo actuator, pneumatic cylinder, voice coil motor, gear, cam, belt, et cetera, may be employed. And, the support mechanism of the inclination mechanism is not specifically limited as described above and, instead, a support mechanism utilizing various roller bearings and slide bearings, link mechanism, elastic members, et cetera, can be used.

And, the transport mechanism for a recording medium is not specifically limited as described above and rather a roller transport, a moving table, et cetera, may be used.

And, instead of the configuration a lá plurality of recording heads fixed onto a carriage, an integrated recording head with a plurality of nozzle rows may be appropriate. And, although a plurality of ink heads per color are combined in the width direction of the recording medium, one long ink head may be used instead.

And, although four color recording heads are placed, the present invention can preferably apply to an image forming apparatus in which merely two rows or more of recording heads are arrayed.

While the correction mechanism of the inclination correction unit is placed on the carriage to which the recording heads are fixed, it may be structured on another member integrated with the recording head or directly on the recording head per se. While the correction mechanism of the inclination correction unit is placed on the transport mechanism for transporting the recording medium, other members integrated with the transport mechanism may be appropriate.

Note that the present invention can be materialized by modifying the components within the scope of the present embodiment in the process of implementing it, instead of being limited by the above described embodiments per se. Also, various inventions may be formed by suitably combining a plurality of components which are disclosed in the above described embodiments.

For example, some components may be removed from the all components put forth by the above described embodiments, and furthermore, components of different embodiments may be appropriately combined.

Further the present invention allows various improvements or changes within the scope thereof instead of being limited to the above described embodiments.

What is claimed is:

1. An image forming apparatus comprising:

a recording head including a plurality of nozzle arrays for ejecting each ink droplet per color for plural colors respectively in a first direction onto a transported recording medium;

a transport mechanism for transporting the recording medium in a second direction in order to form an image thereon;

wherein the nozzle arrays are placed in a predetermined interval, and in a position opposite to the transport mechanism;

an inclination detection unit comprising a sensor for outputting a signal in order to generate information about a relative inclination between the second direction or the transport mechanism and the recording head around an axis that is perpendicular to the recording medium; and a correction unit for calculating based on the signal and correcting a relative inclination between the second direction and the recording head based on the calculation result;

wherein said correction unit has a control unit for generating ejection information based on image information for inputting into said recording head, and the control unit generates ejection information by displacing in a nozzle row direction by a predetermined amount based on said signal; and wherein said predetermined amount is calculated from a reference position, a distance between a reference position and a nozzle row and said signal.

2. The image forming apparatus according to claim 1, wherein said sensor outputs a signal for detecting a relative inclination between a belt which transports said recording medium and said recording heads around said axis.

3. The image forming apparatus according to claim 1 wherein said sensor outputs a signal for detecting a relative inclination between a belt platen, on which a belt for transporting said recording medium is placed, and said recording heads around said axis.

4. The image forming apparatus according to claim 1, wherein said sensor at least comprises a light source and a light receiving element for receiving light emitted from the light source.

5. The image forming apparatus according to claim 4, wherein light emitted from said light source is incident on said light receiving element by way of a target, and both the light source and the light receiving element are placed on one of said recording heads or said transport mechanism, and the target is placed on the other one of said recording heads or said transport mechanism.

6. The image forming apparatus according to claim 5, wherein said target is placed on an entire circumference of said belt.

7. The image forming apparatus according to claim 1, wherein said sensor at least comprises a magnetic member and a magnetic sensor for detecting a magnetism of the magnetic member.

8. The image forming apparatus according to claim 1, wherein said sensor is a velocity sensor for detecting a velocity of said recording medium and/or a belt which transports the recording medium.

9. The image forming apparatus according to claim 8, wherein said velocity sensor is an optical velocity sensor.

10. The image forming apparatus according to claim 9, wherein said optical velocity sensor comprises means for a changeover control of a light path of emitted light of the optical velocity sensor, thereby detecting a velocity from two directions by a time sharing.

11. The image forming apparatus according to claim 1, wherein said inclination detection unit comprises two sets of sensors which are placed separately from each other in a vertical direction vis-a-vis said first direction.

12. The image forming apparatus according to claim 1, wherein said transport mechanism has a belt platen.

* * * * *